US011691144B2

(12) United States Patent
Cottier

(10) Patent No.: US 11,691,144 B2
(45) **Date of Patent: *Jul. 4, 2023**

(54) ASSEMBLIES AND METHODS FOR SCREENING SAMPLE FLUIDS

(71) Applicant: Creoptix AG, Wädenswil (CH)

(72) Inventor: Kaspar Cottier, Wädenswil (CH)

(73) Assignee: Creoptix AG, Wädenswil (CH)

( * ) Notice: Subject to any disclaimer, the term of this patent is extended or adjusted under 35 U.S.C. 154(b) by 282 days.

This patent is subject to a terminal disclaimer.

(21) Appl. No.: 16/772,205

(22) PCT Filed: Dec. 13, 2018

(86) PCT No.: PCT/IB2018/059999

§ 371 (c)(1),
(2) Date: Jun. 12, 2020

(87) PCT Pub. No.: WO2019/116294

PCT Pub. Date: Jun. 20, 2019

(65) Prior Publication Data

US 2021/0069707 A1 Mar. 11, 2021

(30) Foreign Application Priority Data

Dec. 15, 2017 (CH) ..... 01541/17

(51) Int. Cl.
*B01L 3/00* (2006.01)
*B01L 3/02* (2006.01)

(52) U.S. Cl.
CPC ..... *B01L 3/502715* (2013.01); *B01L 3/0293* (2013.01); *B01L 3/50273* (2013.01);
(Continued)

(58) Field of Classification Search
None
See application file for complete search history.

(56) References Cited

U.S. PATENT DOCUMENTS 4,108,602 A 8/1978 Hanson et al.
5,695,720 A 12/1997 Wade et al.
(Continued)

FOREIGN PATENT DOCUMENTS

WO WO-2017/187325 A1 11/2017

OTHER PUBLICATIONS

International Search Report and Written Opinion for PCT/IB2018/059999 dated Mar. 14, 2019, 13 pages.

*Primary Examiner* — Rebecca M Giere
*Assistant Examiner* — Xiaoyan Zou
(74) *Attorney, Agent, or Firm* — Blank Rome LLP

(57) ABSTRACT

There is provided an assembly, useable to screen sample fluids for predefined molecules, the comprising, a needle unit comprising n hollow needles, wherein n is greater than one; a flow cell unit comprising m flow cells, wherein m is greater than one, each flow cell having an input and an output, and a test surface on which ligands can be provided; a first selector valve unit which is fluidly connected between the needle unit and flow cell unit, which is operable to selectively fluidly connect any one of the n hollow needles with the m flow cells in the flow cell unit; a pumping means which is selectively operable to provide negative pressure; a second selector valve unit which is fluidly connected between the pumping means and the output of each flow cell. There are further provided methods of screening sample fluids for predefined molecule.

12 Claims, 4 Drawing Sheets

(52) U.S. Cl.
CPC . *B01L 2200/143* (2013.01); *B01L 2300/0829* (2013.01); *B01L 2300/0877* (2013.01); *B01L 2400/049* (2013.01); *B01L 2400/0633* (2013.01)

(56) References Cited

U.S. PATENT DOCUMENTS

| | | | | |
|---|---|---|---|---|
| 2007/0134808 | A1 | 6/2007 | Sullivan | |
| 2011/0092376 | A1 | 4/2011 | Colston, Jr. et al. | |
| 2013/0260372 | A1 | 10/2013 | Buermann et al. | |
| 2015/0192574 | A1* | 7/2015 | Cottier ..... | G01N 35/085 422/69 |

* cited by examiner

ASSEMBLIES AND METHODS FOR SCREENING SAMPLE FLUIDS

RELATED APPLICATIONS

This application is a national phase of PCT/IB2018/059999, filed on Dec. 13, 2018, which claims the benefit of Swiss Application No. CH015411/17, filed on Dec. 15, 2017. The entire contents of these applications are hereby incorporated by reference.

FIELD OF THE INVENTION

The present invention concerns simplified assemblies, which have less parts compared to prior art assemblies, but which can still allow a plurality of sample fluids to be consecutively flowed through flow cells in rapid succession, thereby allowing screening of said plurality of sample fluids in rapid succession. There is further provided corresponding methods for screening a plurality of sample fluids.

DESCRIPTION OF RELATED ART

Fluidic assemblies for biosensing applications typically comprise a flow cell. As is well recognized in the art, a flow cell is a solid support having a microfluidic channel defined therein; and at least a portion of the surface which defines the microfluidic channel defines a test surface which can be probed using a sensor. The test surface is adapted to receive ligands through immobilization; once immobilized or captured on the test surface, the ligands can bind to predefined molecules. Sample fluids are passed through the flow cell and if said predefined molecules are present in that sample fluid they will become bound to the ligands within the flow cell. Thus it can be determined if a sample fluid contains the predefined molecule by passing the sample fluid through the flow cell and detecting if the ligands in the flow cell have bound to molecules as the sample fluid flows through the flow cell. Alternatively, if the sample fluid contains known concentrations of the predefined molecules, the kinetics of the molecular binding between the ligands and predefined molecules can be analysed. Typically it will be desired to consecutively screen a plurality of sample fluids; for each sample fluid it will need to be picked up, using a hollow needle for example, and then passed through the flow cell; then the needle (and flow cell) must be cleaned before the next sample fluid is screened.

A major drawback of existing screening assemblies and methods for screening a plurality of different sample fluids, is the cycle time, i.e. the time elapsed from the start of the injection of one sample fluid from a needle into a flow cell, to the start of the injection of a next sample into the flow cell, is limited by the time it takes to wash after the first sample and the time it takes to pick up the next sample fluid. The combined pickup and wash times are typically in the order of one to two minutes. With the addition of other necessary steps, such as the need for an equilibrating baseline buffer injection prior to injection, the maximum throughput that such a device can obtain is in the order of 2,000-4,000 samples per day.

Attempts to resolve this problem by been made by simple parallelization, parallel injections of sample fluids into different flow cells. However, the different flow cells may have different characteristics, e.g. different target immobilization levels, thus leading to results which are not comparable. Also, such parallelization often requires the use of one syringe per needle to pick up the sample fluids; this leave to high manufacturing costs, and larger instrument size, and the risk of trapping air in a pump due to incomplete syringe pump priming is increased, and the buffer consumption for operating these devices is very high, requiring large buffer tanks and or frequent buffer change.

It is an aim of the present invention to obviate, or at least mitigate, one or more of the above-mentioned disadvantages.

BRIEF SUMMARY OF THE INVENTION

According to the invention, these aims are achieved by means of an assembly and/or method having the features recited in the independent claims; wherein the dependent claims recite optional features of preferred embodiments.

BRIEF DESCRIPTION OF THE DRAWINGS

The invention will be better understood with the aid of the description of an embodiment given by way of example and illustrated by the figures, in which.

DETAILED DESCRIPTION OF POSSIBLE EMBODIMENTS OF THE INVENTION

Figure 1:
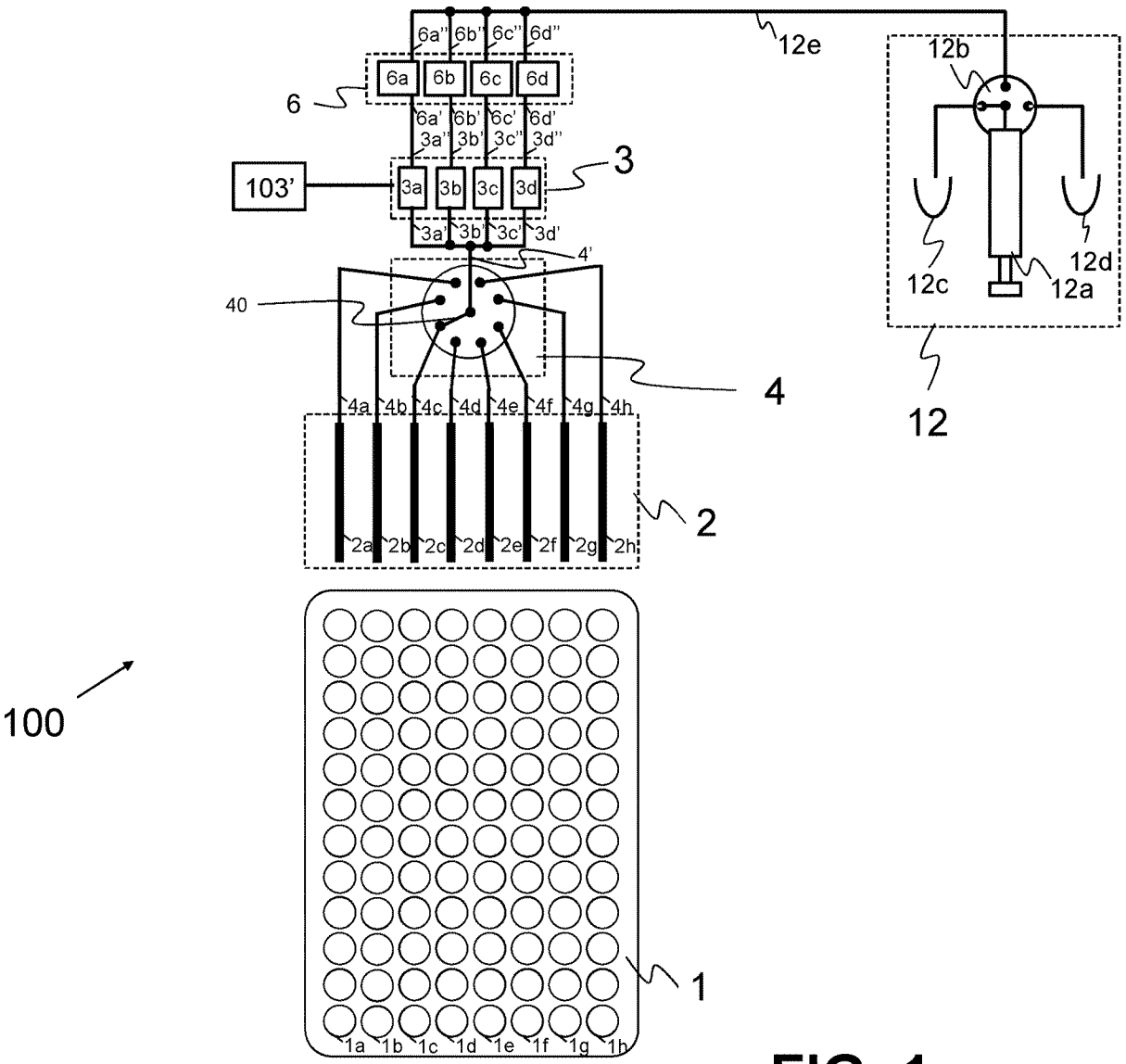
FIG. 1 shows an assembly according to an embodiment of the present invention.
Figure 2:
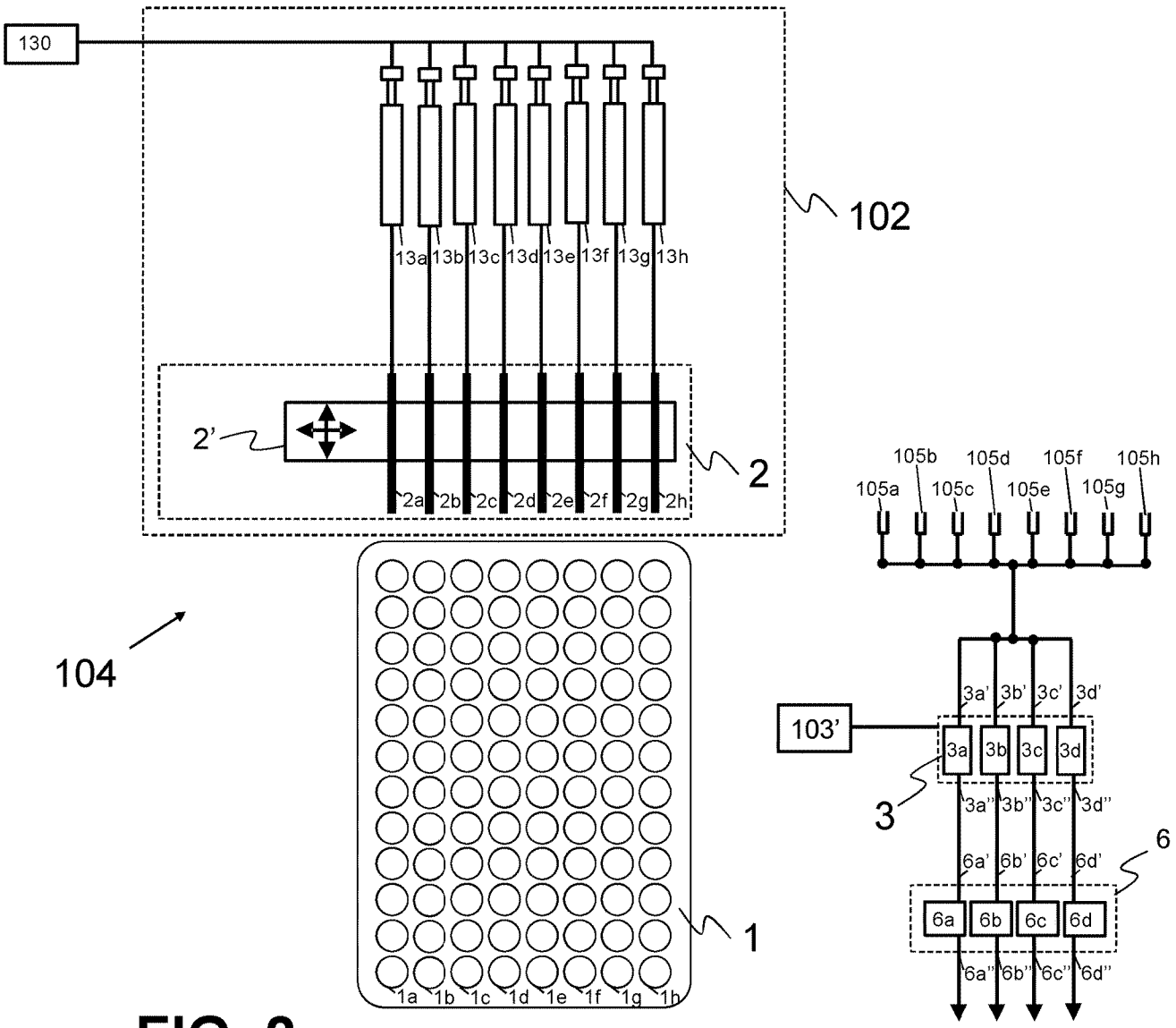
FIG. 2 shows an assembly according to a further embodiment of the present invention.

FIG. 1 illustrates an assembly 101 according to one embodiment of the present invention. The assembly 100 is suitable for high throughput biochemical sensing, for instance screening for unknown molecules having a high affinity towards the ligands, or detection or quantification of known molecules at unknown concentrations in a sample fluids binding to the ligands. Examples include testing small molecule drug candidate binding to a drug target, such as screening of a pharmaceutical compound library; or Fragment Based Screening.

The assembly 100 comprises, a needle unit 2, a flow cell unit 3, a first selector valve unit 4, a second selector valve unit 6, and a pumping means 12. The assembly 100 further comprises the optional feature of a sample holder tray 1.

The sample holder tray 1 comprises a plurality of sample reservoirs 1', specifically the sample holder tray 1 comprises consecutive rows of reservoirs, each row comprising eight reservoirs 1*a-h*. The sample holder tray 1 *s* typically in the form of a micro well plate, such as industry standard 96-well or 384-well micro titer plates, or in the form of a plurality of vials. The reservoirs 1' of the sample holder tray 1 are typically filled with samples which are to be screened; the reservoirs can be filled manually or by means of an automated liquid handling station. Typically, each reservoir 1' is sealed by means of a foil, or by means of a septum in case of vials, in order to avoid concentration mismatches due to evaporation, and to avoid mixing and/or contamination of the sample fluids in each reservoir 1'. In the assembly 100 shown I FIG. 1 the sample holder tray 1 is defined by a 96-well micro titer plate (known in the art), containing twelve rows of eight reservoirs 1*a-h*. Each row comprises a first reservoir 1*a*, a second reservoir 1*b*, a third reservoir 1*c*, a fourth reservoir 1*d*, a fifth reservoir 1*e*, a sixth reservoir 1*f*, a seventh reservoir 1*g*, and an eighth reservoir 1*h*.

The needle unit 2 comprises n hollow needles 2*a-h*, wherein n is greater than one. In this particular example n is equal to eight so needle unit 2 comprises eight hollow needles 2*a-h*; specifically the needle unit 2 comprises a first hollow needle 2*a*, a second hollow needle 2*b*, a third hollow needle 2*c*, a fourth hollow needle 2*d*, a fifth hollow needle 2*e*, a sixth hollow needle 2*f*, a seventh hollow needle 2*g*, and an eight hollow needle 2*h*. However it should be understood that n many have any value greater than one; for example in another embodiment the needle unit 2 may comprise less needles than eight needles, such as for example four needles, or preferably more than eight needles such as sixteen or thirty-two, or sixty-four, or ninety-six needles.

The hollow needles in the needle unit 2 are typically in the form of a conduit with an opening at the bottom, such as a stainless-steel needle or a PEEK tube with a bottom opening. Preferably, the needles are rigid allowing them to be able to pierce a foil or a septum which may (which may cover reservoirs in the sample holder tray 1). Preferably the needle unit 2 can be selectively moved with respect to the sample holder tray 1 e.g. moved to dip the hollow needles into the reservoirs 1' in the sample holder tray 1 (in this case the sample holder tray 1 may be kept stationary); the movement of the needle unit 2 is typically achieved by means of a robotic arm or xyz-table on which the needle unit 2 is mounted (alternatively the needle unit 2 may be kept stationary and the sample holder tray 1 may be moved relative to the needle unit 2 using a robotic arm or xyz table).

The flow cell unit 3 comprises m flow cells 3*a-d*, wherein m is greater than one. In this example m is equal to four so that flow cell unit 3 comprises four flow cells 3*a*-3*d*, namely a first flow cell 3*a*, a second flow cell 3*b*, a third flow cell 3*c* and a fourth flow cell 3*d*. However, it should be understood that m many have any value greater than one (for example the flow cell unit 3 may comprise two flow cells or three flow cells, or eight flow cells, or nine flow cells, or ten flow cells, or twelve flow cells, or sixteen flow cells, or twenty flow cells, or twenty-four flow cells or thirty-two flow cells). Each flow cell 3*a-d* has a respective input 3*a'*-3*d'* and an respective output 3*a"*-3*d"*, and a test surface on which ligands can be provided located between its respective input 3*a'*-3*d'* and output 3*a"*-3*d"*. As is well recognized in the art, a flow cell is a solid support having a fluidic channel (preferably a microfluidic channel) defined therein; and at least a portion of the surface which defines the fluidic channel defines the test surface which can be probed using a sensor.

The ligands are preferably captured or immobilized on the respective test surfaces using amine coupling within a thin hydrogel layer such as a Dextran layer covalently bound to the surface within a flow cell; in another preferred embodiment the ligands are captured by a suitable tag (such as biotin or hexahistidine or glutathione-S-transferase within a gel matrix such as Agarose) which is provides on the test surface of the flow cell.

Preferably the assembly 101 further comprises a sensor 103' which can detect if molecules of a sample fluid which has flowed through one or more of the m flow cells 3*a-d*, have become bound to ligands on the test surface(s) of said one or more flow cells 3*a-d*. The sensor 103' may take any suitable form, for example the sensor 103' may comprise a Surface Plasmon Resonance sensor, or, Waveguide interferometry sensor, or surface acoustic sensor, or potentiometric sensor, which is configured to measure if molecules have become bound to the ligands on the test surface of a flow cell 3*a-d* of the flow cell unit 3. The sensor 103' is preferably operably connected to the flow cell unit 3 so that it can perform such measurements, and preferably provides a time-resolved signal indicative of a physical change near the test surface, such as refractive index changes or changes in charge potential, such physical change being induced by the presence of said predefined molecule. Predefined molecules bind to predefined ligands; therefore if a flow cell has a predefined ligand on its test surface, that ligand being known to bind with a predefined molecule, if after a sample fluid has flowed through the flow cell the sensor 103' indicates that the molecules of that flow cell have become bound to said ligands, this indicates that the sample fluid contained said predefined molecule. In this way the presence (or absence) of predefined molecules in a sample fluid can be determined. Alternatively, if a flow cell has a predefined ligand on its test surface, and that ligand being known or suspected to bind with a predefined molecule, the kinetics and/or affinity of the molecular binding between that ligand and said predefined molecule can be characterized by fitting an appropriate interaction model to the response of the sensor 103' over time, such response having been obtained when flowing several sample fluids containing different concentrations of said predefined molecule through the flow cell and over said test surface. It should be understood that in the present application, if a fluid is said to flow through a flow cell, this means that said fluid has flowed over the test surface of said flow cell.

The first selector valve unit 4 has a single output 4' which is fluidly connected to the m flow cells 3*a-d* in the flow cell unit 3; specifically the single output 4' of the first selector valve unit 4 is fluidly connected to all of the inputs 3*a'*-3*d'* of all of the m flow cells 3*a-d* in the flow cell unit 3.

The first selector valve unit 4 has n inputs 4*a-h* (i.e. the number of inputs 4*a-h* which the first selector valve unit 4 has corresponds to the number of hollow needles in the needle unit 2). As mentioned in this example n is equal to eight therefore the first selector valve unit 4 has eight inputs 4*a-h* (namely a first input 4*a*, second input 4*b*, third input 4*c*, fourth input 4*d*, fifth input 4*e*, sixth input 4*f*, seventh input 4*g*, eight input 4*h*). The first input 4*a* is fluidly connected to the first hollow needle 2*a*; the second input 4*b* is fluidly connected to the second hollow needle 2*b*; the third input 4*c* is fluidly connected to the third hollow needle 2*c*; the fourth input 4*d* is fluidly connected to the fourth hollow needle 2*d*; the fifth input 4*e* is fluidly connected to the fifth hollow needle 2*e*; the sixth input 4*f* is fluidly connected to the sixth hollow needle 2*f*; the seventh input 4*g* is fluidly connected to the seventh hollow needle 2*g*; and the eight input 4*h* is fluidly connected to the eight hollow needle 2*h*.

The first selector valve unit is configured such that it can selectively fluidly connect any one or more of its n inputs 4*a-h* with its single output 4'. Accordingly the first selector valve unit 4 is configured such that it can selectively fluidly connect any one of the hollow needles 2*a-h* (which are fluidly connected to the respective n inputs 4*a-h* of the first selector valve 4) with the m flow cells 3*a-d* (whose inputs 3*a'*-3*d'* are fluidly connected to the single output 4' of the first selector valve unit 4). In this example the first selector valve unit 4 comprises a movable conduit 40; the movable conduit can be moved into eight different positions, in each of which is fluidly connects one said inputs 4*a-h* to the single output 4' (however it should be understood that the first selector valve unit 4 is not limited to having such a configuration).

Specifically in this embodiment the first selector valve unit 4 can be selectively configured into any one of n different configurations (wherein n is the number of hollow needles 2*a-h* in the needle unit 2. As mentioned above n is equal to eight in this example): when the first selector valve unit 4 is in a first configuration the single output 4' is fluidly connected to the first input 4*a* only, thus fluidly connecting the first hollow needle 2*a* only with all of the m flow cells 3*a-d*; when the first selector valve unit 4 a second configuration the single output 4' is fluidly connected to the second input 4*b* only thus fluidly connecting the second hollow needle 2*b* only with all of the m flow cells 3*a-d*; when the first selector valve unit 4 a third configuration the single output 4' is fluidly connected to the third input 4*c* only thus fluidly connecting the third hollow needle 2*c* only with all of the m flow cells 3*a-d*; when the first selector valve unit 4 a fourth configuration the single output 4' is fluidly connected to the fourth input 4*d* only thus fluidly connecting the fourth hollow needle 2*d* only with all of the m flow cells 3*a-d*; when the first selector valve unit 4 a fifth configuration the single output 4' is fluidly connected to the fifth input 4*e* only thus fluidly connecting the fifth hollow needle 2*e* only with all of the m flow cells 3*a-d*; when the first selector valve unit 4 a sixth configuration the single output 4' is fluidly connected to the sixth input 4*f* only thus fluidly connecting the sixth hollow needle 2*f* only with all of the m flow cells 3*a-d*; when the first selector valve unit 4 a seventh configuration the single output 4' is fluidly connected to the seventh input 4*g* only thus fluidly connecting the seventh hollow needle 2*g* only with all of the m flow cells 3*a-d*; when the first selector valve unit 4 an eight configuration the single output 4' is fluidly connected to the eight input 4*h* only thus fluidly connecting the eight hollow needle 2*h* only with all of the m flow cells 3*a-d*.

In the preferred embodiment, the first selector valve unit 4 comprises a rotary valve. In order to move the first selector valve unit 4 into any one of its five different configurations, the movable conduit 40 is positioned at one of five different positions using a motor to a position which allows a fluid passage from the respective input 4*a*'-h' (and thus from the respective hollow needle 2*a-h*) to the single output 4' (note in this embodiment the movable conduit 40 is provided on a rotor and the single output 4' is provided on a stator).

In a further variation of this embodiment, the first selector valve unit 4 comprises 'n' 2/2 solenoid valves or pinch valves, i.e. the number of 2/2 solenoid valves or pinch valves correspond to the number of needles in the needle unit 2.

In this embodiment there is provided a single pumping means 12. The single pumping means 12 is configured so that it is selectively operable to provide negative pressure (e.g. negative fluid pressure) at its output 12*e*. Most preferably the single pumping means 12 is configured so that it is selectively operable to provide positive pressure (e.g. positive fluid pressure) or negative pressure (e.g. negative fluid pressure) at its output 12*e*. The single pumping means 12 may have any suitable configuration. In this example, the single pumping means 12 comprises a syringe 12*a*, a switching valve 12*b*, a buffer reservoir 12*c* which contains a buffer fluid, a waste reservoir 12*d* and an output 12*e*. Preferably, before operating the single pumping mean 12 to provide a positive pressure at its output 12*e*, the single pumping means 12 is first primed by configuring the switching valve 12*b* to fluidly connect the syringe 12*a* to the waste reservoir 12*d*, so as to allow buffer fluid to pass from the syringe 12*a* to the waste reservoir 12*d*; then the buffer fluid contents of the syringe 12*a* are dispensed into the waste reservoir 12*d*. Then the switching valve 12*b* is configured to fluidly connect the syringe 12*a* to the buffer reservoir 12*c*, so as to allow buffer fluid to pass from the buffer reservoir 12*c* to the syringe 12*a*. The syringe 12*a* is then filled with buffer fluid from the buffer reservoir 12*c* by aspirating buffer fluid from the buffer reservoir 12*c*. In order to provide positive pressure, the switching valve 12*b* is then configured to fluidly connect the syringe 12*a* to the output 12*e*; the buffer fluid contained in the syringe 12*a* is then dispensed from the syringe; the dispense buffer fluid creates the positive pressure at the output 12*e*. Similarly, preferably, before providing negative pressure at the output 12*e*, the syringe 12*a* is typically at least partially emptied (and most preferably is fully emptied); the switching valve 12*b* is configured to fluidly connect the syringe 12*a* to the waste reservoir 12*d* so as to allow fluid to pass from the syringe 12*a* to the waste reservoir 12*d*; the fluid contents of the syringe 12*a* is then at least partially emptied into the waste reservoir 12*d*. In order to provide negative pressure, the switching valve 12*b* is configured to fluidly connect the syringe 12*a* to the output 12*e*; fluid present in the output 12*e* is aspirated into the syringe 12*a*; aspirating fluid from the output 12*e* into the syringe 12*a* creates the negative pressure at the output 12*e*.

The second selector valve unit 6 is fluidly connected between respective m outputs 3*a*"-3*d*" of the m flow cells 3*a-d* in said flow cell unit 3 and said pumping means 12. Specifically the second selector valve unit 6 is connected between the output 12*e* of said pumping means 12 and the m outputs 3*a*"-3*d*" of the m flow cells 3*a-d*.

The second selector valve unit 6 is configured to selectively fluidly connect the pumping means 12 with one or more of said m flow cells 3*a-d*.

Specifically, the second selector valve unit 6 comprises m valves, each of the respective m valves is connected between a respective one of said m outputs 3*a*"-3*d*" of the m flow cells 3*a-d* and the output 12*e* of the pumping means 12.

Most preferably the number of valves provided in the second selector valve unit 6 corresponds to the number of flow cells 3*a-d* in the flow cell unit 3. In this example since m is equal to four, the second selector valve unit 6 comprises a first valve 6*a* which has an input 6*a*" and an output 6*a*'; a second valve 6*b* which has an input 6*b*" and an output 6*b*'; a third valve 6*c* which has an input 6*c*" and an output 6*c*'; and a fourth valve 6*d* which has an input 6*d*" and an output 6*d*'.

The input 6*a*" of the first valve 6*a* is fluidly connected to the output 12*e* of the pumping means 12, and the output 6*a*' of the first valve 6*a* is fluidly connected to the output 3*a*" of the first flow cell 3*a*. The input 6*b*" of the second valve 6*b* is fluidly connected to the output 12*e* of the pumping means 12, and the output 6*b*' of the second valve 6*b* is fluidly connected to the output 3*b*" of the second flow cell 3*b*. The input 6*c*" of the third valve 6*c* is fluidly connected to the output 12*e* of the pumping means 12, and the output 6*c*' of the third valve 6*c* is fluidly connected to the output 3*c*" of the third flow cell 3*c*. The input 6*d*" of the fourth valve 6*d* is fluidly connected to the output 12*e* of the pumping means 12, and the output 6*d*' of the fourth valve 17*d* is fluidly connected to the output 3*d*" of the fourth flow cell 3*d*.

Each of the first, second, third and fourth valves 6*a-d* of the second selector valve unit 6 can be selectively opened or closed. Accordingly, when the first valve 6*a* is opened it will fluidly connect the pumping means 12 to the output 3*a*" of the first flow cell 3*a*; when the second valve 6*b* is opened it will fluidly connect the pumping means 12 to the output 3*b*" of the second flow cell; when the third valve 6*c* is opened it will fluidly connect the pumping means 12 to the output 3*c*" of the third flow cell 3*c*; when the fourth valve 6*d* is opened it will fluidly connect the pumping means 12 to the output 3*d*" of the fourth flow cell 3*d*.

The second selector valve unit 6 is selectively arrangeable in at least m+1 different configurations, wherein m is the number of flow cells 3*a-d* in the flow cell unit 3. Accordingly, in this embodiment the second selector valve unit 6 is selectively arrangeable in at least five different configurations:

When the second selector valve unit 6 is in a first configuration, the first valve 6*a* is opened and the second, third, fourth valves 6*b-d* are closed, thus fluid flowing out of the first selector valve unit 4 via single output 4' of the selector valve unit 4, will flow through the first flow cell 3*a* only. Also when the second selector valve unit 6 is in its first configuration the pumping means 12 will be fluidly connected to the output 3*a*" of the first flow cell 3*a* only.

When the second selector valve unit 6 is in a second configuration, the second valve 6*b* is opened and the first, third, fourth valves 6*a,c,d* are closed, thus fluid flowing out of the first selector valve unit 4 via single output 4' of the selector valve unit 4, will flow through the second flow cell 3*b* only. Also when the second selector valve unit 6 is in its second configuration, the pumping means 12 will be fluidly connected to the output 3*b*" of the second flow cell 3*b* only.

When the second selector valve unit 6 is in a third configuration, the third valve 6*c* is opened and the first, second, and fourth valves 6*a,b,d* are closed, thus fluid flowing out of the first selector valve unit 4 via single output 4' of the selector valve unit 4, will flow through the third flow cell 3*c* only. Also when the second selector valve unit 6 is in its third configuration the pumping means 12 will be fluidly connected to the output 3*c*" of the third flow cell 3*c* only.

When the second selector valve unit 6 is in a fourth configuration, the fourth valve 6*c* is opened and the first, second, and third valves 6*a,b,c* are closed, thus fluid flowing out of the first selector valve unit 4 via single output 4' of the selector valve unit 4, will flow through the fourth flow cell 3*d* only. Also when the second selector valve unit 6 is in its fourth configuration, the pumping means 12 will be fluidly connected to the output 3*d*" of the fourth flow cell 3*d* only.

When the second selector valve unit 6 is in a fifth configuration, all of the first, second, third and fourth valves 6*a-d* are opened, thus fluid flowing out of the first selector valve unit 4 via single output 4' of the selector valve unit 4, will flow through all of the flow cells 3*a-d* in the flow cell unit 3. Also when the second selector valve unit 6 is in its fifth configuration, the pumping means 12 will be simultaneously fluidly connected to all of the outputs 3*a*"-3*d*" of all of the flow cells 3*a-d* in the flow cell unit 3.

Optionally the second selector valve unit 6 could be selectively arrangeable in a sixth configuration wherein all of the first, second, third and fourth valves 6*a-d* are closed; thus fluid flowing out of the first selector valve unit 4 via single output 4' of the selector valve unit 4, will not flow through any of the flow cells 3*a-d*.

It should be understood that each of said m valves 6*a-d* in the second selector valve unit 6 may take any suitable form. For example, most preferably each of said m valves 6*a-d* is a solenoid valve. In a further variation of this embodiment instead of a second selector valve unit 6 comprising m solenoid valves 6*a-d*, the second selector valve unit 6 may comprises a rotary valve which can be arranged in at least five configurations: a first configuration wherein the second selector valve unit 6 fluidly connects the output 3*a*" of the first flow cell 3*a* only with the pumping means 12; a second configuration wherein the second selector valve unit 6 fluidly connects the output 3*b*" of the second flow cell 3*b* only with the pumping means 12; a third configuration wherein the second selector valve unit 6 fluidly connects the output 3*c*" of the third flow cell 3*c* only with the pumping means 12; a fourth configuration wherein the second selector valve unit 6 fluidly connects the output 3*d*" of the fourth flow cell 3*a* only with the pumping means 12; and a fifth configuration wherein the second selector valve unit 6 simultaneously fluidly connects all of the outputs 3*a*"-d" of all of the flow cells 3*a-d* in the flow cell unit 3 with the pumping means 12.

Advantageously the assembly 100 can be used to screen a plurality of different sample fluids consecutively, for predefined molecules (i.e. molecules which are known or suspected to bind to the ligands provided on the test surfaces of one or more of the flow cells 3*a-d*). During use different sample fluids which are to be screened may be provided in each respective reservoir 1' of the sample holder tray 1; in other words the sample fluids provided in said different reservoirs 1' may have different compositions (how this is not essential; it could be that some of the sample fluids in different reservoirs 1' have the same composition). In this example the different sample fluids having different compositions are provided in said respective reservoirs 1': In particular, in a first row of reservoirs, a first sample fluid is provided in a first reservoir 1*a*' of that row; a second sample fluid is provided in a second reservoir 1*b*' of said row; a third sample fluid is provided in a third reservoir 1*c*' of said row; a fourth sample fluid is provided in a fourth reservoir 1*d*' of said row; a fifth sample fluid is provided in a fifth reservoir 1*e*' of said row; a sixth sample fluid is provided in a sixth reservoir 1*f*' of said row; a seventh sample fluid is provided in a seventh reservoir 1*g*' of said row; an eight sample fluid is provided in an eight reservoir 1*h*' of said row.

The needle unit 2 is then arranged so that each of the respective n hollow needles 2*a-h* is simultaneously inserted into a respective reservoir 1*a-h* of the sample tray holder 1; specifically the needle unit 2 is arranged so that, the first hollow needle 2*a* is inserted into said first reservoir 1*a*', the second hollow needle 2*b* is inserted into said second reservoir 1*b*', the third hollow needle 2*c* is inserted into said third reservoir 1*c*', the fourth hollow needle 2*d* is inserted into said fourth reservoir 1*d*', the fifth hollow needle 2*e* is inserted into said fifth reservoir 1*e*', the sixth hollow needle 2*f* is inserted into said sixth reservoir 1*f*', the seventh hollow needle 2*g* is inserted into said seventh reservoir 1*g*', the eight hollow needle 2*h* is inserted into said eight reservoir 1*h*'. At least the tip of each hollow needle 2*a-h* is submerged in the respective sample fluids contained in the respective reservoirs 1*a*'-h'. It should be noted that the moveable stage 2' may move the needle unit 2 into a position wherein each of the respective n hollow needles 2 are simultaneously inserted into a respective reservoir 1*a-h*.

The second selector valve unit 6 is arranged into its fifth configuration so that all of the first, second, third and fourth valves 6*a-d* are opened.

The first selector valve unit 4 is then arranged into its first configuration so that the single output 4' is fluidly connected to the first input 4*a* only, thus fluidly connecting the first hollow needle 2*a* only with all of the m flow cells 3*a-d*.

The flow cells 3*a-d* in the flow cell unit 3 are then contacted with the first sample fluid which is present in the first reservoir 1*a* in an injection step. The pumping means 12 is then operated to provide a negative pressure at its output 12*e*. The negative pressure causes the first sample fluid which is present in the first reservoir 1*a*, to be aspirated into the first hollow needle 2*a*, pass through the first hollow needle 2*a* into the first input 4*a* of the first selector valve unit 4, out of the first selector valve unit via the single output 4', and from the single output 4' into all of the flow cells 3*a-d* in the flow cell unit 3.

Accordingly the first sample fluid will contact the test surfaces of each of the first, second, third and fourth flow cells 3*a-d*; and more specifically will contact ligands which are present on said respective test surfaces. If the first sample fluid contains molecules which can bind to the ligands which are on the test surfaces of any the first, second, third and fourth flow cells 3*a-d*, these molecules will become bound to those ligands when the first sample fluid flows through that flow cell. As the first sample fluid flows through the first, second, third and fourth flow cells 3*a-d*, this sensor 103' is operated to detect if molecules of the first sample fluid have become bound to ligands on the test surfaces of any of the first, second, third or fourth flow cells 3*a-d*.

Optionally, the flow cells 3*a-d* in the flow cell unit 3 are then rinsed in a rinsing step. In order to carry out the rising step, the switching valve 12*b* is configured to fluidly connect the syringe 12*a* to the waste reservoir 12*d*, so as to allow buffer fluid to pass from the syringe 12*a* to the waste reservoir 12*d*; then the buffer fluid contents of the syringe 12*a* are dispensed into the waste reservoir 12*d*. Then the switching valve 12*b* is configured to fluidly connect the syringe 12*a* to the buffer reservoir 12*c*, so as to allow buffer fluid to pass from the buffer reservoir 12*c* to the syringe 12*a*. The syringe 12*a* is then filled with buffer fluid from the buffer reservoir 12*c* by aspirating buffer fluid from the buffer reservoir 12*c*. The pumping means 12 is then operated to provide a positive pressure at its output 12*e*. The positive pressure causes buffer fluid, which is present at the syringe 12*a*, to flow into the flow cells 3*a-d* in the flow cell unit 3, effectively displacing the first sample fluid and thus rinsing the flow cells 3*a-d*, and into the single output 4' of the first selector valve unit 4 and out of the first input 4*a* of the first selector valve unit 4 into the first hollow needle 2*a* and into the reservoir 1*a*.

Then, the first selector valve unit 4 is moved to its second position so that the single output 4' is fluidly connected to the second input 4*b* only, thus fluidly connecting the second hollow needle 2*b* only with all of the m flow cells 3*a-d*.

The pumping means 12 is then operated to provide a negative pressure at its output 12*e*. The negative pressure causes the second sample fluid which is present in the second reservoir 1*b*, to be aspirated into the second hollow needle 22*b*, pass through the second hollow needle 2*b* into the second input 4*b* of the first selector valve unit 4, out of the first selector valve unit via the single output 4', and from the single output 4' into all of the flow cells 3*a-d* in the flow cell unit 3.

Accordingly, the second sample fluid will contact the test surfaces of each of the first, second, third and fourth flow cells 3*a-d*; and more specifically will contact ligands which are present on said respective test surfaces. If the second sample fluid contains molecules which can bind to the ligands which are on the test surfaces of any the first, second, third and fourth flow cells 3*a-d*, these molecules will become bound to those ligands when the second sample fluid flows through that flow cell. As the second sample fluid flows through the first, second, third and fourth flow cells 3*a-d*, the sensor 103' is operated to detect if molecules of the second sample fluid have become bound to ligands on the test surfaces of any of the first, second, third or fourth flow cells 3*a-d*.

Optionally, the flow cells 3*a-d* in the flow cell unit 3 are then rinsed by carrying out further rinsing step. Therefore the switching valve 12*b* is configured to fluidly connect the syringe 12*a* to the waste reservoir 12*d*, so as to allow buffer fluid to pass from the syringe 12*a* to the waste reservoir 12*d*; then the buffer fluid contents of the syringe 12*a* are dispensed into the waste reservoir 12*d*. Then the switching valve 12*b* is configured to fluidly connect the syringe 12*a* to the buffer reservoir 12*c*, so as to allow buffer fluid to pass from the buffer reservoir 12*c* to the syringe 12*a*. The syringe 12*a* is then filled with buffer fluid from the buffer reservoir 12*c* by aspirating buffer fluid from the buffer reservoir 12*c*. The pumping means 12 is then operated to provide a positive pressure at its output 12*e*. The positive pressure causes buffer fluid in the syringe 12*a* to flow into the flow cells 3*a-d* in the flow cell unit 3, effectively displacing the first sample fluid and thus rinsing the flow cells 3*a-d*, and into the single output 4' of the first selector valve unit 4 and out of the second input 4*b* of the first selector valve unit 4 into the second hollow needle 2*b* and into the second reservoir 1*b*.

The first selector valve unit 4 is then arranged into its third configuration so that the single output 4' is fluidly connected to the third input 4*c* only, thus fluidly connecting the third hollow needle 2*c* only with all of the m flow cells 3*a-d*. The flow cells 3*a-d* in the flow cell unit 3 are then contacted with the third sample fluid which is present in the third reservoir 1*c* in an injection step: The pumping means 12 is operated to provide a negative pressure at its output 12*e*. The negative pressure causes the third sample fluid which is present in the third reservoir 1*c*, to be aspirated into the third hollow needle 2*c*, pass through the third hollow needle 2*c* into the third input 4*c* of the first selector valve unit 4, out of the first selector valve unit via the single output 4', and from the single output 4' into all of the flow cells 3*a-d* in the flow cell unit 3.

Accordingly, the third sample fluid, which was present in the third reservoir 1*c*, will contact the test surfaces of each of the first, second, third and fourth flow cells 3*a-d*; and more specifically will contact ligands which are present on said respective test surfaces. If the third sample fluid contains molecules which can bind to the ligands which are on the test surfaces of any the first, second, third and fourth flow cells 3*a-d*, these molecules will become bound to those ligands when the third sample fluid flows through that flow cell. As the third sample fluid flows through the first, second, third and fourth flow cells 3*a-d*, the sensor 103' is operated to detect if molecules of the second sample fluid have become bound to ligands on the test surfaces of any of the first, second, third or fourth flow cells 3*a-d*.

Optionally, the flow cells 3*a-d* in the flow cell unit 3 are then rinsed by carrying out further rinsing step. Therefore the switching valve 12*b* is configured to fluidly connect the syringe 12*a* to the waste reservoir 12*d*, so as to allow buffer fluid to pass from the syringe 12*a* to the waste reservoir 12*d*; then the buffer fluid contents of the syringe 12*a* are dispensed into the waste reservoir 12*d*. Then the switching valve 12*b* is configured to fluidly connect the syringe 12*a* to the buffer reservoir 12*c*, so as to allow buffer fluid to pass from the buffer reservoir 12*c* to the syringe 12*a*. The syringe 12*a* is then filled with buffer fluid from the buffer reservoir 12*c* by aspirating buffer fluid from the buffer reservoir 12*c*. The pumping means 12 is then operated to provide a positive pressure at its output 12*e*. The positive pressure causes buffer fluid to flow into the flow cells 3*a-d* in the flow cell unit 3, effectively displacing the third sample fluid and thus rinsing the flow cells 3*a-d*, and into the single output 4' of the first selector valve unit 4 and out of the third input 4*c* of the first selector valve unit 4 into the third hollow needle 2*c* and into the third reservoir 1*c*.

The first selector valve unit 4 is then arranged into its fourth configuration so that the single output 4' is fluidly connected to the fourth input 4*d* only, thus fluidly connecting the fourth hollow needle 2*d* only with all of the m flow cells 3*a-d*.

The flow cells 3*a-d* in the flow cell unit 3 are then contacted with the fourth sample fluid which is present in the fourth reservoir 1*d* in an injection step: The pumping means 12 is operated to provide a negative pressure at its output 12*e*. The negative pressure causes the fourth sample fluid which is present in the fourth reservoir 1*d*, to be aspirated into the fourth hollow needle 2*d*, pass through the fourth hollow needle 2*d* into the fourth input 4*d* of the first selector valve unit 4, out of the first selector valve unit via the single output 4', and from the single output 4' into all of the flow cells 3*a-d* in the flow cell unit 3.

Accordingly, the fourth sample fluid, which was present in the fourth reservoir 1*d*, will contact the test surfaces of each of the first, second, third and fourth flow cells 3*a-d*; and more specifically will contact ligands which are present on said respective test surfaces. If the fourth sample fluid contains molecules which can bind to the ligands which are on the test surfaces of any the first, second, third and fourth flow cells 3*a-d*, these molecules will become bound to those ligands when the fourth sample fluid flows through that flow cell. As the fourth sample fluid flows through the first, second, third and fourth flow cells 3*a-d*, this sensor 103' is operated to detect if molecules of the fourth sample fluid have become bound to ligands on the test surfaces of any of the first, second, third or fourth flow cells 3*a-d*.

Optionally, the flow cells 3*a-d* in the flow cell unit 3 are then rinsed by carrying out further rinsing step. Therefore the switching valve 12*b* is configured to fluidly connect the syringe 12*a* to the waste reservoir 12*d*, so as to allow buffer fluid to pass from the syringe 12*a* to the waste reservoir 12*d*; then the buffer fluid contents of the syringe 12*a* are dispensed into the waste reservoir 12*d*. Then the switching valve 12*b* is configured to fluidly connect the syringe 12*a* to the buffer reservoir 12*c*, so as to allow buffer fluid to pass from the buffer reservoir 12*c* to the syringe 12*a*. The syringe 12*a* is then filled with buffer fluid from the buffer reservoir 12*c* by aspirating buffer fluid from the buffer reservoir 12*c*. The pumping means 12 is then operated to provide a positive pressure at its output 12*e*. The positive pressure causes buffer fluid to flow into the flow cells 3*a-d* in the flow cell unit 3, effectively displacing the fourth sample fluid and thus rinsing the flow cells 3*a-d*, and into the single output 4' of the first selector valve unit 4 and out of the fourth input 4*d* of the first selector valve unit 4 into the fourth hollow needle 2*d* and into the fourth reservoir 1*d*.

The first selector valve unit 4 is then arranged into its fifth configuration so that the single output 4' is fluidly connected to the fifth input 4*e* only, thus fluidly connecting the fifth hollow needle 2*e* only with all of the m flow cells 3*a-d*.

The flow cells 3*a-d* in the flow cell unit 3 are then contacted with the fifth sample fluid which is present in the fifth reservoir 1*e* in an injection step: The pumping means 12 is operated to provide a negative pressure at its output 12*e*. The negative pressure causes the fourth sample fluid which is present in the fifth reservoir 1*e*, to be aspirated into the fifth hollow needle 2*e*, pass through the fifth hollow needle 2*e* into the fifth input 4*e* of the first selector valve unit 4, out of the first selector valve unit via the single output 4', and from the single output 4' into all of the flow cells 3*a-d* in the flow cell unit 3.

Accordingly, the fifth sample fluid, which was present in the fifth reservoir 1*e*, will contact the test surfaces of each of the first, second, third and fourth flow cells 3*a-d*; and more specifically will contact ligands which are present on said respective test surfaces. If the fifth sample fluid contains molecules which can bind to the ligands which are on the test surfaces of any the first, second, third and fourth flow cells 3*a-d*, these molecules will become bound to those ligands when the fifth sample fluid flows through that flow cell. As the fifth sample fluid flows through the first, second, third and fourth flow cells 3*a-d*, this sensor 103' is operated to detect if molecules of the fifth sample fluid have become bound to ligands on the test surfaces of any of the first, second, third or fourth flow cells 3*a-d*.

Optionally, the flow cells 3*a-d* in the flow cell unit 3 are then rinsed by carrying out further rinsing step. Therefore the switching valve 12*b* is configured to fluidly connect the syringe 12*a* to the waste reservoir 12*d*, so as to allow buffer fluid to pass from the syringe 12*a* to the waste reservoir 12*d*; then the buffer fluid contents of the syringe 12*a* are dispensed into the waste reservoir 12*d*. Then the switching valve 12*b* is configured to fluidly connect the syringe 12*a* to the buffer reservoir 12*c*, so as to allow buffer fluid to pass from the buffer reservoir 12*c* to the syringe 12*a*. The syringe 12*a* is then filled with buffer fluid from the buffer reservoir 12*c* by aspirating buffer fluid from the buffer reservoir 12*c*. The pumping means 12 is then operated to provide a positive pressure at its output 12*e*. The positive pressure causes buffer fluid to flow into the flow cells 3*a-d* in the flow cell unit 3, effectively displacing the fifth sample fluid and thus rinsing the flow cells 3*a-d*, and into the single output 4' of the first selector valve unit 4 and out of the fifth input 4*e* of the first selector valve unit 4 into the fifth hollow needle 2*e* and into the fifth reservoir 1*e*.

The first selector valve unit 4 is then arranged into its sixth configuration so that the single output 4' is fluidly connected to the sixth input 4*f* only, thus fluidly connecting the sixth hollow needle 2*f* only with all of the m flow cells 3*a-d*.

The flow cells 3*a-d* in the flow cell unit 3 are then contacted with the sixth sample fluid which is present in the sixth reservoir 1*f* in an injection step: The pumping means 12 is operated to provide a negative pressure at its output 12*f*. The negative pressure causes the fourth sample fluid which is present in the sixth reservoir 1*f*, to be aspirated into the sixth hollow needle 2*f*, pass through the sixth hollow needle 2*f* into the sixth input 4*f* of the first selector valve unit 4, out of the first selector valve unit via the single output 4', and from the single output 4' into all of the flow cells 3*a-d* in the flow cell unit 3.

Accordingly, the sixth sample fluid, which was present in the sixth reservoir 1*f*, will contact the test surfaces of each of the first, second, third and fourth flow cells 3*a-d*; and more specifically will contact ligands which are present on said respective test surfaces. If the sixth sample fluid contains molecules which can bind to the ligands which are on the test surfaces of any the first, second, third and fourth flow cells 3*a-d*, these molecules will become bound to those ligands when the sixth sample fluid flows through that flow cell. As the sixth sample fluid flows through the first, second, third and fourth flow cells 3*a-d*, this sensor 103' is operated to detect if molecules of the sixth sample fluid have become bound to ligands on the test surfaces of any of the first, second, third or fourth flow cells 3*a-d*.

Optionally, the flow cells 3*a-d* in the flow cell unit 3 are then rinsed by carrying out further rinsing step. Therefore, the switching valve 12*b* is configured to fluidly connect the syringe 12*a* to the waste reservoir 12*d*, so as to allow buffer fluid to pass from the syringe 12*a* to the waste reservoir 12*d*; then the buffer fluid contents of the syringe 12*a* are dispensed into the waste reservoir 12*d*. Then the switching valve 12*b* is configured to fluidly connect the syringe 12*a* to the buffer reservoir 12*c*, so as to allow buffer fluid to pass from the buffer reservoir 12*c* to the syringe 12*a*. The syringe 12*a* is then filled with buffer fluid from the buffer reservoir 12*c* by aspirating buffer fluid from the buffer reservoir 12*c*. The pumping means 12 is then operated to provide a positive pressure at its output 12*f*. The positive pressure causes buffer fluid to flow into the flow cells 3*a-d* in the flow cell unit 3, effectively displacing the sixth sample fluid and thus rinsing the flow cells 3*a-d*, and into the single output 4' of the first selector valve unit 4 and out of the sixth input 4*f* of the first selector valve unit 4 into the sixth hollow needle 2*f* and into the sixth reservoir 1*f*.

The first selector valve unit 4 is then arranged into its seventh configuration so that the single output 4' is fluidly connected to the seventh input 4*g* only, thus fluidly connecting the seventh hollow needle 2*g* only with all of the m flow cells 3*a-d*.

The flow cells 3*a-d* in the flow cell unit 3 are then contacted with the seventh sample fluid which is present in the seventh reservoir 1*g* in an injection step: The pumping means 12 is operated to provide a negative pressure at its output 12*g*. The negative pressure causes the fourth sample fluid which is present in the seventh reservoir 1*g*, to be aspirated into the seventh hollow needle 2*g*, pass through the seventh hollow needle 2*g* into the seventh input 4*g* of the first selector valve unit 4, out of the first selector valve unit via the single output 4', and from the single output 4' into all of the flow cells 3*a-d* in the flow cell unit 3.

Accordingly, the seventh sample fluid, which was present in the seventh reservoir 1*g*, will contact the test surfaces of each of the first, second, third and fourth flow cells 3*a-d*; and more specifically will contact ligands which are present on said respective test surfaces. If the seventh sample fluid contains molecules which can bind to the ligands which are on the test surfaces of any the first, second, third and fourth flow cells 3*a-d*, these molecules will become bound to those ligands when the seventh sample fluid flows through that flow cell. As the seventh sample fluid flows through the first, second, third and fourth flow cells 3*a-d*, this sensor 103' is operated to detect if molecules of the seventh sample fluid have become bound to ligands on the test surfaces of any of the first, second, third or fourth flow cells 3*a-d*.

Optionally, the flow cells 3*a-d* in the flow cell unit 3 are then rinsed by carrying out further rinsing step. Therefore, the switching valve 12*b* is configured to fluidly connect the syringe 12*a* to the waste reservoir 12*d*, so as to allow buffer fluid to pass from the syringe 12*a* to the waste reservoir 12*d*; then the buffer fluid contents of the syringe 12*a* are dispensed into the waste reservoir 12*d*. Then the switching valve 12*b* is configured to fluidly connect the syringe 12*a* to the buffer reservoir 12*c*, so as to allow buffer fluid to pass from the buffer reservoir 12*c* to the syringe 12*a*. The syringe 12*a* is then filled with buffer fluid from the buffer reservoir 12*c* by aspirating buffer fluid from the buffer reservoir 12*c*. The pumping means 12 is then operated to provide a positive pressure at its output 12*g*. The positive pressure causes buffer fluid to flow into the flow cells 3*a-d* in the flow cell unit 3, effectively displacing the seventh sample fluid and thus rinsing the flow cells 3*a-d*, and into the single output 4' of the first selector valve unit 4 and out of the seventh input 4*g* of the first selector valve unit 4 into the seventh hollow needle 2*g* and into the seventh reservoir 1*g*.

The first selector valve unit 4 is then arranged into its eight configuration so that the single output 4' is fluidly connected to the eight input 4*h* only, thus fluidly connecting the eight hollow needle 2*h* only with all of the m flow cells 3*a-d*.

The flow cells 3*a-d* in the flow cell unit 3 are then contacted with the eighth sample fluid which is present in the eight reservoir 1*h* in an injection step: The pumping means 12 is operated to provide a negative pressure at its output 12*h*. The negative pressure causes the fourth sample fluid which is present in the eighth reservoir 1*h*, to be aspirated into the eighth hollow needle 2*h*, pass through the eighth hollow needle 2*h* into the eighth input 4*h* of the first selector valve unit 4, out of the first selector valve unit via the single output 4', and from the single output 4' into all of the flow cells 3*a-d* in the flow cell unit 3.

Accordingly, the eight sample fluid, which was present in the eight reservoir 1*h*, will contact the test surfaces of each of the first, second, third and fourth flow cells 3*a-d*; and more specifically will contact ligands which are present on said respective test surfaces. If the eighth sample fluid contains molecules which can bind to the ligands which are on the test surfaces of any the first, second, third and fourth flow cells 3*a-d*, these molecules will become bound to those ligands when the eighth sample fluid flows through that flow cell. As the eighth sample fluid flows through the first, second, third and fourth flow cells 3*a-d*, this sensor 103' is operated to detect if molecules of the eighth sample fluid have become bound to ligands on the test surfaces of any of the first, second, third or fourth flow cells 3*a-d*.

Optionally, the flow cells 3*a-d* in the flow cell unit 3 are then rinsed by carrying out further rinsing step. Therefore, the switching valve 12*b* is configured to fluidly connect the syringe 12*a* to the waste reservoir 12*d*, so as to allow buffer fluid to pass from the syringe 12*a* to the waste reservoir 12*d*; then the buffer fluid contents of the syringe 12*a* are dispensed into the waste reservoir 12*d*. Then the switching valve 12*b* is configured to fluidly connect the syringe 12*a* to the buffer reservoir 12*c*, so as to allow buffer fluid to pass from the buffer reservoir 12*c* to the syringe 12*a*. The syringe 12*a* is then filled with buffer fluid from the buffer reservoir 12*c* by aspirating buffer fluid from the buffer reservoir 12*c*. The pumping means 12 is then operated to provide a positive pressure at its output 12*h*. The positive pressure causes buffer fluid to flow into the flow cells 3*a-d* in the flow cell unit 3, effectively displacing the eighth sample fluid and thus rinsing the flow cells 3*a-d*, and into the single output 4' of the first selector valve unit 4 and out of the eighth input 4*h* of the first selector valve unit 4 into the eighth hollow needle 2*h* and into the eight reservoir 1*h*.

Advantageously, in the respective rinsing step mentioned above, the first, second, third, fourth, fifth, sixth, seventh and eight sample fluids displaced by the buffer fluid are collected in the respective reservoirs 1*a-h* and can be reused for further analysis. In a preferred embodiment, the volume of the buffer fluid which is dispensed from the pumping means 12 into the flow cells 3*a-d* in the flow cell unit 3 during the rising step, is equal to or larger than the volume of each respective sample fluid which flowed into the flow cells 3*a-d* in the flow cell unit 3 during the respective injection step. Preferably, the volume of the buffer fluid which is dispensed from the pumping means 12 into the flow cells 3*a-d* in the flow cell unit 3 during the rising step, is larger than twice the injection volume of sample fluid, or larger than three times the volume of sample fluid which flowed into the flow cells 3*a-d* in the flow cell unit 3 during the respective injection step.

Then, the needle unit 2 is washed to avoid contamination of next samples. The needle unit is then moved to the next row of reservoirs in the sample holder tray 1, and is arranged so that each of the respective n hollow needles 2*a-h* is simultaneously inserted into a respective reservoir 1*a-h* belonging to said next row of the sample tray holder 1; and the above-mentioned steps are repeated for each of the sample fluids contained in the reservoirs in said next row. These steps are preferably repeated until all of the sample fluids contained in reservoirs of the sample tray holder 1 have been screened. Advantageously, in the present invention the sample fluids contained in the reservoirs of the sample tray holder, can be made to contact the same test surface (i.e. the test surface of the same flow cell) in rapid succession.

As mentioned above, the sensor 103' is operated to detect if molecules of a sample fluid have become bound to ligands on the test surfaces of any of the first, second, third or fourth flow cells 3*a-d*. Preferably the sensor signal is recorded to monitor binding of sample molecules to the sensor surface, and binding is detected by for instance evaluating the difference of the signals obtained in the first flow cell 3*a* or second flow cell 3*b* or third flow cell 3*c*, to the signals obtained on the reference flow cell 3*d* which has no ligand immobilized. For example, one way to detect using the sensor 103' if molecules of a particular sample fluid have become bound to ligands on the test surface of any of a flow cell 3*a-d* is to compare an output signal of the sensor 103 to a reference output signal which is a signal which the sensor 103' outputs when said sample fluid flows through said flow cell when no ligands are provided on its test surface. Thus, the method may further comprise the steps of, for each of the respective m (eight) sample fluids: passing that sample fluid through a flow cell which is without ligands on its test surface; obtaining an output signal from the sensor 103' as the sample fluid passes through said flow cell which is without ligands on its test surface, wherein this output signal defines a reference signal. Then any of the above-mentioned steps of operating the sensor 103' to detect if molecules of a sample fluid have become bound to ligands on the test surfaces of any of the first, second, third or fourth flow cells 3*a-d*, may comprise, obtaining an output signal from the sensor as the sample fluid passes through the first, second, third or fourth flow cells 3*a-d* (one or more of which have ligands on its test surface); and comparing said output signal with said reference signal. It is then determined that a molecule of said sample fluid has bound to the ligands of a flow cell if the output signal differs from the reference signal.

Optionally, prior to performing the method of screening sample fluids for predefined molecules, described above, a step of providing ligands on the respective test surfaces of one or more of said m flow cells 3*a-h* in said flow cell unit 3 may be performed.

It should be noted that in one embodiment, prior to providing ligands on the respective test surfaces of one or more of said m flow cells 3*a-h* in said flow cell unit 3, a step of obtaining a reference signal from the sensor 103' for a sample fluid may be performed (and this step may be performed for a plurality of different sample fluid so that a reference signal from the sensor 103' is obtained for each different sample fluid). In order to obtain a reference signal for a sample fluid, the sample fluid is passed through a flow cell 3*a-d* when the flow cell 3*a-d* is without ligands on its test surface; obtaining an output signal from the sensor 103' as the sample fluid passes through said flow cell 3*a-d*, wherein this output signal defines said reference signal. It should be understood that the same steps as described above to pass a sample fluid though the flow cells for screening, could be performed in order to pass the sample fluid through the flow cell 3*a-d* (before that flow cell is provided with ligands on its test surface) in order to obtain said reference signal from the sensor 103' for that sample fluid.

Most preferably such a further step of providing ligands on the respective test surfaces of one or more of said m flow cells 3*a-h* in said flow cell unit 3 would be performed prior to using the assembly 101 to screen one or more sample fluids for predefined molecules. Most preferably the step of providing ligands on the respective test surfaces of one or more of said m flow cells 3*a-h* in said flow cell unit 3 comprises providing ligands on the test surfaces of a plurality (at least two) said flow cells 3*a-h* in said flow cell unit 3, wherein the type of ligands provided on the test surfaces differ between flow cells such that the test surfaces of said plurality of flow cells have different types of ligands.

In the following there will be described the steps carried out: ligands of a first type, which can bind to a first type of molecule, are provided on the test surface of the first flow cell 3*a*; ligands of a second type, which can bind to a second type of molecule, are provided on the test surface of the second flow cell 3*b*; ligands of a third type, which can bind to a third type of molecule, are provided on the test surface of the third flow cell 3*c*; ligands of a fourth type, which can bind to a fourth type of molecule, are provided on the test surface of the fourth flow cell 3*d* (it is understood that the number of ligands can be less than four, in which case at least one flow cell will be without any ligand provided thereon, and such flow cell without any ligand provided thereon can be used for referencing purposes):

A first immobilization reagent is provided in a first reservoir 1*a* of a row in said sample try holder 1. It should be understood that the first immobilization reagent may comprise any suitable immobilization reagent; for example the first immobilization reagent may comprise a mixture of 1-Ethyl-3-(3-dimethylaminopropyl)carbodiimide (EDC) and N-hydroxysuccinimide (NHS) and/or Ethanolamine for amine coupling, and/or NiCl2 for His-Tag coupling, and/or any other suitable reagents. In this example the first immobilization reagent comprises a 1:1 mixture of EDC/NHS. It should be noted that an immobilization reagent and a substance which, when passed over the test surface of a flow cell, sticks to the test surface; the immobilization reagent can hold ligands (which are subsequently passed into the flow cell) so that the ligands are indirectly held on the test surface of the flow cell via the immobilization reagent.

r different types of ligands are provided in respective r different reservoirs 1*a-h* of said row of said sample tray holder 1, wherein r is greater than one. As mentioned in this example four different types of ligands will be provided on the respective test surfaces of the respective flow cells 3*a-d* accordingly in this example r is four. It should be understood that r may have any value greater than one. Preferably r (then number of different types of ligands) is equal to m (the number of flow cells 3*a-d* in the flow cell unit 3. In this example r is equal to m so four different types of ligands are provided in the respective second, third, fourth and fifth reservoirs 1*b*'-f' of said row (i.e. the same row to which said first reservoir 1*a*' belongs) of said sample tray holder 1:

Ligands of a first type (referred to hereafter as first ligands) are provided in the second reservoir 1*b* of said row. In this example said first ligands, optionally diluted in acetate buffer, are provided in the second reservoir 1*b*.

Ligands of a second type (referred to hereafter as second ligands) are provided in the third reservoir 1*c*. In this example said second ligands, optionally diluted in acetate buffer, are provided in the second reservoir 1*c*.

Ligands of a third type (referred to hereafter as third ligands) are provided in the fourth reservoir 1*d'*. In this example said third ligands, optionally diluted in acetate buffer, is provided in the fourth reservoir 1*d'*.

Ligands of a fourth type (referred to hereafter as fourth ligands) are provided in the fifth reservoir 1*e*. In this example said fourth ligands, optionally diluted in acetate buffer, are provided in the fifth reservoir 1*e*.

A second immobilization reagent is provided in at least one of the remaining reservoirs 1*f-h* in said row. In this example the second immobilization reagent comprises Ethanolamine, however it will be understood that the second immobilization reagent may take any suitable form. In this example the second immobilization reagent is provided in the sixth reservoir 1*f* of said row.

Optionally a buffer is provided in the seventh and eight reservoirs 1*g*, 1*h* of said row.

The needle unit 2 is then arranged so that each of the respective n hollow needles 2*a-h* is simultaneously inserted into a respective reservoir 1*a-h*; at least the tip of each hollow needle 2*a-h* is simultaneously submerged in the respective sample fluid contained in the respective reservoir 1*a-h* into which it is inserted.

The second selector valve unit 6 is arranged into its fifth configuration so that all of the first, second, third and fourth valves 6*a-d* are opened. Also when the second selector valve unit 6 is in its fifth configuration, the pumping means 12 will be simultaneously fluidly connected to all of the outputs 3*a*"-3*d*" of all of the flow cells 3*a-d* in the flow cell unit 3.

The first selector valve unit 4 is then arranged into its first configuration so that the single output 4' is fluidly connected to the first input 4*a* only, thus fluidly connecting the first hollow needle 2*a* only with all of the m flow cells 3*a-d*.

The pumping means 12 is then operated to provide a negative pressure at its output 12*e*. The negative pressure causes the first immobilization reagent which is present in the first reservoir 1*a*, to be aspirated into the first hollow needle 2*a*, pass through the first hollow needle 2*a* into the first input 4*a* of the first selector valve unit 4, out of the first selector valve unit 4 via the single output 4', and from the single output 4' into all of the flow cells 3*a-d* in the flow cell unit 3.

Accordingly the first immobilization reagent will contact the test surfaces of each of the first, second, third and fourth flow cells 3*a-d*. When the first immobilization reagent flows through the first, second, third and fourth flow cells 3*a-d*, the first immobilization reagent will contact the test surfaces of each flow cell 3*a-d*, thereby activating the respective test surfaces. Activation of a test surface of a flow cell means providing an immobilization reagent (i.e. an reagent which can hold a ligand) on the test surface of the flow cell. An immobilization reagent may include reactive groups by carboxyl activation for example. Importantly, once a test surface of a flow cell has been activated by the first immobilization reagent, ligands which subsequently contact that test surface (e.g. ligands which flow over that test surface) will become attached to said test surface. The ligands which have become attached to the test surface, can in turn bind to predefined molecules in sample fluids which flow through said flow cell (the sensor 103' can be used to detect if predefined molecules in a sample fluid have bound to the ligands on the test surface of a flow cell).

The second selector valve unit 6 is arranged into its first configuration so that the first valve 6*a* is opened and the second, third, fourth valves 6*b-d* are closed. Also, when the second selector valve unit 6 is in its first configuration the pumping means 12 will be fluidly connected to the output 3*a*" of the first flow cell 3*a* only.

The first selector valve unit 4 is then arranged into its second configuration so that the single output 4' is fluidly connected to the second input 4*b* only, thus fluidly connecting the second hollow needle 2*b* only with all of the first flow cell 3*a* only.

The pumping means 12 is then operated to provide a negative pressure at its output 12*e*. The negative pressure causes the first ligands which are present in the second reservoir 1*b*, to be aspirated into the second hollow needle 2*b*, pass through the second hollow needle 2*b* into the second input 4*b* of the first selector valve unit 4, out of the first selector valve unit 4 via the single output 4', and from the single output 4' into the first flow cell 3*a* only.

As the first ligands flow through the first flow cell 3*a* they will become attached to the test surface of the first flow cell 3*a* (the first immobilization reagent which flowed over the test surface of the first flow cell 3*a* in the preceding step primed the test surface of the first flow cell 3*a* so that the first ligands will attach the first immobilization reagent which is present on the test surface of the first flow cell 3*a* when the first ligands flow over the test surface of the first flow cell 3*a*; in other words the first ligands will be indirectly attached to the test surface of the first flow cell 3*a* via the first immobilization reagent which is present on the test surface of the first flow cell 3). Accordingly the test surface of the first flow cell 3*a* is thus provided with the first ligands which can bind to a predefined molecule.

Optionally, the sensor 103' is used to monitor the amount of first ligands which attach to the test surface of the first flow cell 3*a*. This can be done by recording the signal output by the sensor 103' as the first ligands flow through the first flow cell 3*a*.

The second selector valve unit 6 is arranged into its second configuration so that the second valve 6*b* is opened and the first, third, fourth valves 6*a,c,d* are closed. Also when the second selector valve unit 6 is in its second configuration, the pumping means 12 will be fluidly connected to the output 3*b*" of the second flow cell 3*b* only.

The first selector valve unit 4 is then arranged into its third configuration so that the single output 4' is fluidly connected to the third input 4*c* only, thus fluidly connecting the third hollow needle 2*c* only with the second flow cell 3*b* only.

The pumping means 12 is then operated to provide a negative pressure at its output 12*e*. The negative pressure causes the second ligands which are present in the third reservoir 1*c*, to be aspirated into the third hollow needle 2*c*, pass through the third hollow needle 2*c* into the third input 4*c* of the first selector valve unit 4, out of the first selector valve unit 4 via the single output 4', and from the single output 4' into the second flow cell 3*b* only.

As the second ligands flow through the second flow cell 3*b* they will become attached to the test surface of the second flow cell 3*b* (the first immobilization reagent which flowed over the test surface of the second flow cell 3*b* in the preceding step primed the test surface of the second flow cell 3*b* so that the second ligands will attach to the second immobilization reagent which is present on the test surface of the second flow cell 3*b* when the second ligands flow over the test surface of the second flow cell 3*b*; in other words the second ligands will be indirectly attached to the test surface of the second flow cell 3*b* via the second immobilization reagent which is present on the test surface of the second flow cell 3*b*). Accordingly the test surface of the second flow cell 3*b* is thus provided with the second ligands which can bind to a predefined molecule.

Optionally, the sensor 103' is used to monitor the amount of second ligands which attach to the test surface of the second flow cell 3*b*. This can be done by recording the signal output by the sensor 103' as the second ligands flow through the second flow cell 3*b*.

The second selector valve unit 6 is arranged into its third configuration so that the third valve 6*c* is opened and the first, second, and fourth valves 6*a,b,d* are closed. Also when the second selector valve unit 6 is in its third configuration the pumping means 12 will be fluidly connected to the output 3*c*" of the third flow cell 3*c* only.

The first selector valve unit 4 is then arranged into its fourth configuration so that the single output 4' is fluidly connected to the fourth input 4*d* only, thus fluidly connecting the fourth hollow needle 2*d* only with the third flow cell 3*c* only.

The pumping means 12 is then operated to provide a negative pressure at its output 12*e*. The negative pressure causes the third ligands which are present in the fourth reservoir 1*d*, to be aspirated into the fourth hollow needle 2*d*, pass through the fourth hollow needle 2*d* into the fourth input 4*d* of the first selector valve unit 4, out of the first selector valve unit 4 via the single output 4', and from the single output 4' into the third flow cell 3*c* only.

As the third ligands flow through the third flow cell 3*c* they will become attached to the test surface of the third flow cell 3*c* (the first immobilization reagent which flowed over the test surface of the third flow cell 3*c* in the preceding step primed the test surface of the third flow cell 3*c* so that the third ligands will attach to the third immobilization reagent which is present on the test surface of the third flow cell 3*c* when the third ligands flow over the test surface of the third flow cell 3*c*; in other words the third ligands will be indirectly attached to the test surface of the third flow cell 3*c* via the third immobilization reagent which is present on the test surface of the third flow cell 3*c*). Accordingly the test surface of the third flow cell 3*c* is thus provided with the third ligands which can bind to a predefined molecule.

Optionally, the sensor 103' is used to monitor the amount of third ligands which attach to the test surface of the third flow cell 3*c*. This can be done by recording the signal output by the sensor 103' as the third ligands flow through the third flow cell 3*c*.

The second selector valve unit 6 is arranged into its fourth configuration so that the fourth valve 6*d* is opened and the first, second, and third valves 6*a,b,c* are closed. Also when the second selector valve unit 6 is in its fourth configuration, the pumping means 12 will be fluidly connected to the output 3*d*" of the fourth flow cell 3*d* only.

The first selector valve unit 4 is then arranged into its fifth configuration so that the single output 4' is fluidly connected to the fifth input 4*e* only, thus fluidly connecting the fifth hollow needle 2*e* only with the fourth flow cell 3*d* only.

The pumping means 12 is then operated to provide a negative pressure at its output 12*e*. The negative pressure causes the fourth ligands which are present in the fifth reservoir 1*e*, to be aspirated into the fifth hollow needle 2*e*, pass through the fifth hollow needle 2*e* into the fifth input 4*e* of the first selector valve unit 4, out of the first selector valve unit 4 via the single output 4', and from the single output 4' into the fourth flow cell 3*d* only.

As the fourth ligands flow through the fourth flow cell 3*d* they will become attached to the test surface of the fourth flow cell 3*d* (the first immobilization reagent which flowed over the test surface of the fourth flow cell 3*d* in the preceding step primed the test surface of the fourth flow cell 3*d* so that the fourth ligands will attach to the fourth immobilization reagent which is present on test surface of the fourth flow cell 3*d* when the fourth ligands flow over the test surface of the fourth flow cell 3*d*; in other words the fourth ligands will be indirectly attached to the test surface of the fourth flow cell 3*d* via the fourth immobilization reagent which is present on the test surface of the fourth flow cell 3*d*). Accordingly the test surface of the fourth flow cell 3*d* is thus provided with the fourth ligands which can bind to a predefined molecule.

Optionally, the sensor 103' is used to monitor the amount of fourth ligands which attach to the test surface of the fourth flow cell 3*d*. This can be done by recording the signal output by the sensor 103' as the fourth ligands flow through aarther embodiment of the present invention. The assembly 104 has many of the same features as the assembly 100 shown in FIG. 1 and like features are awarded the same reference numbers.

The assembly 104 comprises a plurality of pumping means 13*a-h*. The number of pumping means 13*a-h* corresponds to the number of hollow needles 2*a-h* in the needle unit 2, thus there are n pumping means 13*a-h*. Each respective pumping means 13*a-h* is fluidly connected to a respective hollow needle 2*a-h* of the needle unit 2. Each of the pumping means 13*a-h* can be operated to provide positive or negative pressure to a respective hollow needle 2*a-h*; each of the pumping means 13*a-h* preferably contain a buffer liquid reservoir. In this example each pumping means 13*a-h* is defined by a respective syringe pump 13*a-h* having a syringe; the syringe of each syringe pump 13*a-h* contains buffer liquid (preferably each syringe is filled with buffer liquid). The plurality of pumping means 13*a-h* and needle unit 2, together define a carrier module 102.

It is understood that although in this example the assembly 104 comprises a plurality of pumping means 13*a-h*, the assembly 104 may comprise an alternative configuration instead of the plurality of pumping means 13*a-h*; for example instead of the plurality of pumping means 13*a-h* the assembly 104 may comprise a single pumping module which comprises a single syringe pump and n switching valves, where the single syringe pump is fluidly connected to the inlet ports of each of the n switching valves in parallel, and each of the outputs of the n switching valves is fluidly connected to one respective hollow needle 2*a-h*, thus allowing to provide positive or negative pressure to the hollow needle 2*a-h* individually or collectively by controlling the corresponding switching valves and the syringe pump.

Notably the assembly 104 does not comprise a first selector valve 4. However, the assembly 104 does comprise a plurality of sockets 105*a-h* which are each fluidly connected to the inputs 3*a*"-d" of all of the flow cells 3*a-d* in the flow cell unit 3. The number of sockets 105*a-h* corresponds to the number of hollow needles 2*a-h* in the needle unit 2, thus there are n sockets 105*a-h*. Each socket 105*a-h* is suitable for cooperating with a respective hollow needle 2*a-h* in the needle unit 2; specifically, each socket 105*a-h* is suitable for receiving the tip of a respective needle 2*a-h* in the needle unit 2. Each socket 105*a-h* typically comprises an elastomeric membrane or septum; the elastomeric membrane or septum is configured so that when the respective socket 105*a-h* is moved to abut a respective hollow needle 2*a-h* the elastomeric membrane or septum forms a sealed interface with the hollow needle 2*a-h*; the elastomeric membrane or septum thus allows the socket 15*a-h* to be selectively fluidly connected to the hollow needles 2*a-h*.

The carrier module 102 is movable from a first position wherein the respective hollow needles 2*a-h* in the needle unit 2 are inserted into respective reservoirs 1*a-h* in the sample tray holder 1 (when the carrier module is at the first position the pumping means 13*a-h* can be operated to provide a negative pressure which causes fluid in the respective reservoirs 1*a-h* to be aspirated into the respective hollow needles 2*a-h*), to a second position where the respective hollow needles 2*a-h* are inserted into respective sockets 105*a-h* (when the carrier module is at the second position each of the pumping means 13*a-h* can be consecutively operated to provide a positive pressure which causes fluid in the respective hollow needles 2*a-h* to be expelled into the respective sockets 105*a-h*, and from the respective sockets 105*a-h* into said flow cells 3*a-d*). Any suitable means may be used to move the carrier module 102, for example a robotic arm or an xy table could be used. In this example the carrier module 102 is mounted on an xy table 2', which is operable to move the carrier module 102 between said first and second positions.

The assembly 104 can be used to screen a plurality of different sample fluids consecutively, for predefined molecules (i.e. molecules which are known to bind to the ligands provided on the test surfaces of one or more of the flow cells 3*a-d*). During use different sample fluids which are to be screened may be provided in each respective reservoir 1' of the sample holder tray 1; in other words the sample fluids provided in said different reservoirs 1' may have different compositions (how this is not essential; it could be that some of the sample fluids in different reservoirs 1' have the same composition). In this example the different sample fluids having different compositions are provided in said respective reservoirs 1': In particular, in a first row of reservoirs, a first sample fluid is provided in a first reservoir 1*a'* of that row; a second sample fluid is provided in a second reservoir 1*b'* of said row; a third sample fluid is provided in a third reservoir 1*c'* of said row; a fourth sample fluid is provided in a fourth reservoir 1*d'* of said row; a fifth sample fluid is provided in a fifth reservoir 1*e'* of said row; a sixth sample fluid is provided in a sixth reservoir 1*f'* of said row; a seventh sample fluid is provided in a seventh reservoir 1*g'* of said row; an eight sample fluid is provided in an eight reservoir 1*h'* of said row.

The carrier module 102 is moved to its first position. In other words the carrier module 102 then arranged so that each of the respective n hollow needles 2*a-h* is inserted into a respective reservoir 1*a-h* of the sample tray holder 1; specifically the needle unit 2 is arranged so that, the first hollow needle 2*a* is inserted into said first reservoir 1*a'*, the second hollow needle 2*b* is inserted into said second reservoir 1*b'*, the third hollow needle 2*c* is inserted into said third reservoir 1*c'*, the fourth hollow needle 2*d* is inserted into said fourth reservoir 1*d'*, the fifth hollow needle 2*e* is inserted into said fifth reservoir 1*e'*, the sixth hollow needle 2*f* is inserted into said sixth reservoir 1*f'*, the seventh hollow needle 2*g* is inserted into said seventh reservoir 1*g'*, the eight hollow needle 2*h* is inserted into said eight reservoir 1*h'*. At least the tip of each hollow needle 2*a-h* is submerged in the respective sample fluids contained in the respective reservoirs 1*a'*-h'. It should be noted that the moveable stage 2' may move the needle unit 2 into a position wherein each of the respective n hollow needles 2 are simultaneously inserted into a respective reservoir 1*a-h*.

Each of the pumping means 13*a-h* is then operated to provide a negative pressure. Each of the pumping means 13*a-h* may be operated simultaneously, or, alternatively, each of the pumping means 13*a-h* may be operated consecutively. The negative pressure causes a volume of the respective sample fluids which are present in the reservoirs 1*a-h*, to be each aspirated into the respective hollow needle 2*a-h* in the needle unit 2. Said volume of each of the respective sample fluids which are aspirated into each respective hollow needles 2*a-h*, is referred to hereafter as the pickup volume; in other words said pickup volume is defined as the volume of sample fluid present in one of the hollow needles 2*a-h*. Most preferably the same volume of sample fluid is aspirated into the respective hollow needles 2*a-h*; in other words each of the respective hollow needles 2*a-h* will have equal, or substantially equal, pickup volume. Accordingly, after this step has been performed, the first, second, third, fourth, fifth, sixth, seventh, and eight sample fluids are contained in the respective first, second, third, fourth, fifth, sixth, seventh, and eight hollow needles 2*a-h*.

The carrier module 102 is then moved to its second position.

The second selector valve 6 is arranged into its fifth configuration, so that all of the first, second, third and fourth valves 6*a-d* are opened.

Each of the pumping means 13*a-h* is then operated to consecutively provide a positive pressure. The positive pressure causes the respective sample fluids which are present in the respective hollow needle 2*a-h* to consecutively flow through sockets 105*a-h* and all of the flow cells 3*a-d* in the flow cell unit.

Most preferably the assembly 104 comprises a processor 130 which operates the pumping means 13*a-h*; most preferably the processor 130 which operates the pumping means 13*a-h* is configured so that the time between operating one of the pumping means 13*a-h* to provide positive pressure and operating the next pumping means 13*a-h* to provide positive pressure is less than 10 seconds.

As was the case with in the assembly 100, as each respective sample fluid flows though the flow cells 3*a-d*, the sensor 103' will be used to detect if any molecules in of that sample fluid binds to ligands on the test surfaces of any of the flow cells 3*a-d*.

Optionally, the flow cells 3*a-d* in the flow cell unit 3 are then rinsed in a rinsing step. To carry out said rinsing step the processor 130 which operates the plurality of pumping means 13*a-h*, so that each of the pump syringes 13*a-h* respectively aspirate a volume of buffer fluid which is greater than the pickup volume; the aspirated buffer fluid flows through each respective hollow needle 2*a-h* and through sockets 105*a-h* and all of the flow cells 3*a-d* in the flow cell unit, thereby effectively rinsing all of the flow cells 3*a-d* in the flow cell unit. It is understood that such a rinsing step can be executed between each injection of sample fluids into the flow cell unit.

Preferably the needle unit 2 is washed to avoid contamination of next samples.

The carrier module 102 is moved into its first position so that respective needles 2*a-h* are inserted into respective reservoirs 1*a-h* belonging to said next row in the sample tray holder 1; and the above mentioned steps are repeated for each of the sample fluids contained in the reservoirs in said next row. These steps are preferably repeated until all of the sample fluids contained in reservoirs of the sample tray holder 1 have been screened. Advantageously, in the present invention the sample fluids contained in the reservoirs of the sample tray holder, can be made to contact the same test surface (i.e. the test surface of the same flow cell) in rapid succession.

Optionally, prior to performing any of the method of screening sample fluids for predefined molecules, described above, a step of providing ligands on the respective test surfaces of one or more of said m flow cells 3*a-h* in said flow cell unit 3 may be performed: ligands of a first type, which can bind to a first type of molecule, are provided on the test surface of the first flow cell 3*a*; ligands of a second type, which can bind to a second type of molecule, are provided on the test surface of the second flow cell 3*b*; ligands of a third type, which can bind to a third type of molecule, are provided on the test surface of the third flow cell 3*c*; ligands of a fourth type, which can bind to a fourth type of molecule, are provided on the test surface of the fourth flow cell 3*d* (it is understood that the number of ligands can be less than four, in which case at least one flow cell will be without any ligand provided thereon, and such flow cell without any ligand provided thereon can be used for referencing purposes):

A first immobilization reagent is provided in a first reservoir 1*a* of a row in said sample try holder 1. It should be understood that the first immobilization reagent may comprise any suitable immobilization reagent; for example the first immobilization reagent may comprise a mixture of 1-Ethyl-3-(3-dimethylaminopropyl)carbodiimide (EDC) and N-hydroxysuccinimide (NHS) and/or Ethanolamine for amine coupling, and/or NiCl2 for His-Tag coupling, and/or any other suitable reagents. In this example the first immobilization reagent comprises a 1:1 mixture of EDC/NHS. It should be noted that an immobilization reagent and a substance which, when passed over the test surface of a flow cell, sticks to the test surface; the immobilization reagent can hold ligands (which are subsequently passed into the flow cell) so that the ligands are indirectly held on the test surface of the flow cell via the immobilization reagent.

r different types of ligands are provided in respective r different reservoirs 1*a-h* of said row of said sample tray holder 1, wherein r is greater than one. As mentioned in this example four different types of ligands will be provided on the respective test surfaces of the respective flow cells 3*a-d* accordingly in this example r is four. It should be understood that r may have any value greater than one. Preferably r (then number of different types of ligands) is equal to m (the number of flow cells 3*a-d* in the flow cell unit 3. In this example r is equal to m so four different types of ligands are provided in the respective second, third, fourth and fifth reservoirs 1*b*'-f' of said row (i.e. the same row to which said first reservoir 1*a*' belongs) of said sample tray holder 1:

Ligands of a first type (referred to hereafter as first ligands) are provided in the second reservoir 1*b* of said row. In this example said first ligands, optionally diluted in acetate buffer, are provided in the second reservoir 1*b*.

Ligands of a second type (referred to hereafter as second ligands) are provided in the third reservoir 1*c*. In this example said second ligands, optionally diluted in acetate buffer, are provided in the second reservoir 1*c*.

Ligands of a third type (referred to hereafter as third ligands) are provided in the fourth reservoir 1*d*'. In this example said third ligands, optionally diluted in acetate buffer, is provided in the fourth reservoir 1*d*'.

Ligands of a fourth type (referred to hereafter as fourth ligands) are provided in the fifth reservoir 1*e*. In this example said fourth ligands, optionally diluted in acetate buffer, are provided in the fifth reservoir 1*e*.

A second immobilization reagent is provided in at least one of the remaining reservoirs 1*f-h* in said row. In this example the second immobilization reagent comprises Ethanolamine, however it will be understood that the second immobilization reagent may take any suitable form. In this example the second immobilization reagent is provided in the sixth reservoir 1*f* of said row.

Optionally a buffer fluid is provided in the seventh and eight reservoirs 1*g*, 1*h* of said row.

The carrier module 102 is moved into its first position.

Each of the pumping means 13*a-h* is then operated to provide a negative pressure. Each of the pumping means 13*a-h* may be operated simultaneously, or, alternatively, each of the pumping means 13*a-h* may be operated consecutively. The negative pressure causes a pickup volume of the respective sample fluids which are present in the reservoirs 1*a-h*, to be each aspirated into the respective hollow needle 2*a-h* in the needle unit 2. Accordingly, after this step has been performed, the first immobilization reagent is contained in the first hollow needle 2*a*, the first ligands are contained in the second hollow needle 2*b*, the second ligands are contained in the third hollow needle 2*c*, the third ligands are contained in the fourth hollow needle 2*d*, the fourth ligands are contained in the fifth hollow needle 2*e*, the second immobilization reagent is contained in the sixth hollow needle 2*f*, and optionally a buffer fluid is contained in the seventh and eighth hollow needles 2*g-h*.

The carrier module 102 is then moved to its second position.

The second selector valve 6 is then arranged into its fifth configuration, so that all of the first, second, third and fourth valves 6*a-d* are opened.

The first pumping means 13*a* is then operated to provide a positive pressure.

Accordingly, the first immobilization reagent will flow from the first hollow needle 2*a* through the first socket 105*a* and through the first, second, third and fourth flow cells 3*a-d*. When the first immobilization reagent flows through the first, second, third and fourth flow cells 3*a-d*, the first immobilization reagent will contact the test surfaces of each flow cell 3*a-d*, thereby activating the respective test surfaces.

The first pumping means 13*a* is then operated to stop providing positive pressure.

The second selector valve unit 6 is arranged into its first configuration so that the first valve 6*a* is opened and the second, third, fourth valves 6*b-d* are closed.

The second pumping means 13*b* is then operated to provide a positive pressure.

Accordingly, the first ligands which are present in the second hollow needle 2*b*, pass through the second socket 105*b* into the first flow cell 3*a* only.

As the first ligands flow through the first flow cell 3*a* they will become attached to the test surface of the first flow cell 3*a* (the first immobilization reagent which flowed over the test surface of the first flow cell 3*a* in the preceding step primed the test surface of the first flow cell 3*a* so that the first ligands will attach to first immobilization reagent which is present on the test surface of the first flow cell 3*a* when the first ligands flow over the test surface of the first flow cell 3*a*; in other words the first ligands will be indirectly attached to the test surface of the first flow cell 3*a* via the first immobilization reagent which is present on the test surface of the first flow cell 3). Accordingly the test surface of the first flow cell 3*a* is thus provided with the first ligands which can bind to a predefined molecule.

Optionally, the sensor 103' is used to monitor the amount of first ligands which attach to the test surface of the first flow cell 3*a*. This can be done by recording the signal output by the sensor 103' as the first ligands flow through the first flow cell 3*a*.

The second pumping means 13*b* is then operated to stop providing positive pressure.

The second selector valve unit 6 is arranged into its second configuration so that the first second valve 6*b* is opened and the first valve 6*a*, and third and fourth valves 6*c-d*, are closed.

The third pumping means 13*c* is then operated to provide a positive pressure.

Accordingly, the second ligands which are present in the third hollow needle 2*c*, pass through the third socket 105*c* into the second flow cell 3*b* only.

As the second ligands flow through the second flow cell 3*b* they will become attached to the test surface of the second flow cell 3*b* (the first immobilization reagent which flowed over the test surface of the second flow cell 3*b* in the preceding step primed the test surface of the second flow cell 3*b* so that the second ligands will attach to the second immobilization reagent which is present on the test surface of the second flow cell 3*b* when the second ligands flow over the test surface of the second flow cell 3*b*; in other words the second ligands will be indirectly attached to the test surface of the second flow cell 3*b* via the second immobilization reagent which is present on the test surface of the second flow cell 3*b*). Accordingly the test surface of the second flow cell 3*b* is thus provided with the second ligands which can bind to a predefined molecule.

Optionally, the sensor 103' is used to monitor the amount of second ligands which attach to the test surface of the second flow cell 3*b*. This can be done by recording the signal output by the sensor 103' as the second ligands flow through the second flow cell 3*b*.

The third pumping means 13*c* is then operated to stop providing positive pressure.

The second selector valve unit 6 is arranged into its third configuration so that the third valve 6*c* is opened and the first, second, and fourth valves 6*a,b,d* are closed.

The fourth pumping means 13*d* is then operated to provide a positive pressure.

Accordingly, the third ligands which are present in the fourth hollow needle 2*d*, pass through the fourth socket 105*d* into the third flow cell 3*c* only.

As the third ligands flow through the third flow cell 3*c* they will become attached to the test surface of the third flow cell 3*c* (the first immobilization reagent which flowed over the test surface of the third flow cell 3*c* in the preceding step primed the test surface of the third flow cell 3*c* so that the third ligands will attach to the third immobilization reagent which is present on test surface of the third flow cell 3*c* when the third ligands flow over the test surface of the third flow cell 3*c*; in other words the third ligands will be indirectly attached to the test surface of the third flow cell 3*c* via the third immobilization reagent which is present on the test surface of the third flow cell 3*c*). Accordingly the test surface of the third flow cell 3*c* is thus provided with the third ligands which can bind to a predefined molecule.

Optionally, the sensor 103' is used to monitor the amount of third ligands which attach to the test surface of the third flow cell 3*c*. This can be done by recording the signal output by the sensor 103' as the third ligands flow through the third flow cell 3*c*.

The fourth pumping means 13*d* is then operated to stop providing positive pressure.

The second selector valve unit 6 is arranged into its fourth configuration so that the fourth valve 6*d* is opened and the first, second, and third valves 6*a,b,c* are closed.

The fifth pumping means 13*e* is then operated to provide a positive pressure.

Accordingly, the fourth ligands which are present in the fifth hollow needle 2*e*, pass through the fifth socket 105*e* into the fourth flow cell 3*d* only.

As the fourth ligands flow through the fourth flow cell 3*d* they will become attached to the test surface of the fourth flow cell 3*d* (the first immobilization reagent which flowed over the test surface of the fourth flow cell 3*d* in the preceding step primed the test surface of the fourth flow cell 3*d* so that the fourth ligands will attach to the fourth immobilization reagent which is present on the test surface of the fourth flow cell 3*d* when the fourth ligands flow over the test surface of the fourth flow cell 3*d*; in other words the fourth ligands will be indirectly attached to the test surface of the fourth flow cell 3*d* via the fourth immobilization reagent which is present on the test surface of the fourth flow cell 3*d*). Accordingly the test surface of the fourth flow cell 3*d* is thus provided with the fourth ligands which can bind to a predefined molecule.

Optionally, the sensor 103' is used to monitor the amount of fourth ligands which attach to the test surface of the fourth flow cell 3*d*. This can be done by recording the signal output by the sensor 103' as the fourth ligands flow through the fourth flow cell 3*d*.

The fifth pumping means 13*e* is then operated to stop providing positive pressure.

The second selector valve unit 6 is arranged into its fifth configuration so that all of the first, second, third and fourth valves 6*a-d* are opened.

The sixth pumping means 13*f* is then operated to provide a positive pressure.

Accordingly, the second immobilization reagent which is present in the sixth hollow needle 2*f*, passes through the sixth socket 105*f* into all of the flow cells 3*a-d*.

When the second immobilization reagent flows through the first, second, third and fourth flow cells 3*a-d*, the second immobilization reagent will act to passivate the test surfaces of the respective first, second, third and fourth flow cells 3*a-d*.

The sixth pumping means 13*e* is then operated to stop providing positive pressure.

Optionally, the second selector valve unit 6 is maintained in its fifth configuration.

Optionally, the seventh pumping means 13*g* is then operated to provide a positive pressure.

Accordingly, the buffer fluid which is present in the seventh hollow needle 2*g*, passes through the seventh socket 105*g* into all of the flow cells 3*a-d*. When the buffer flows through the first, second, third and fourth flow cells 3*a-d*, the buffer will act to equilibrate the test surfaces within the flow cells 3*a-d*. In the present invention equilibrate a test surface means to stabilize the test surface in order to reduce drift effects on the sensor readout.

The seventh pumping means 13*g* is then operated to stop providing positive pressure.

Optionally, the second selector valve unit 6 is maintained in its fifth configuration.

Optionally, the eighth pumping means 13*h* is then operated to provide a positive pressure.

Accordingly, the buffer fluid which is present in the eight hollow needle 2*h*, passes through the eighth socket 105*h* into all of the flow cells 3*a-d*. When the buffer flows through the first, second, third and fourth flow cells 3*a-d*, the buffer will act to equilibrate the test surfaces within the flow cells 3*a-d*.

It should be understood that the flow cell unit 3 used in any of the above-mentioned assembly embodiments may be provided in a cartridge which can be selectively removed from the assembly; the cartridge may be a disposable cartridge for example. It should be understood that the cartridge may take any suitable form; however, the cartridge will always contain the flow cells 3*a-d* of the flow cell unit 3.

Figure 4:
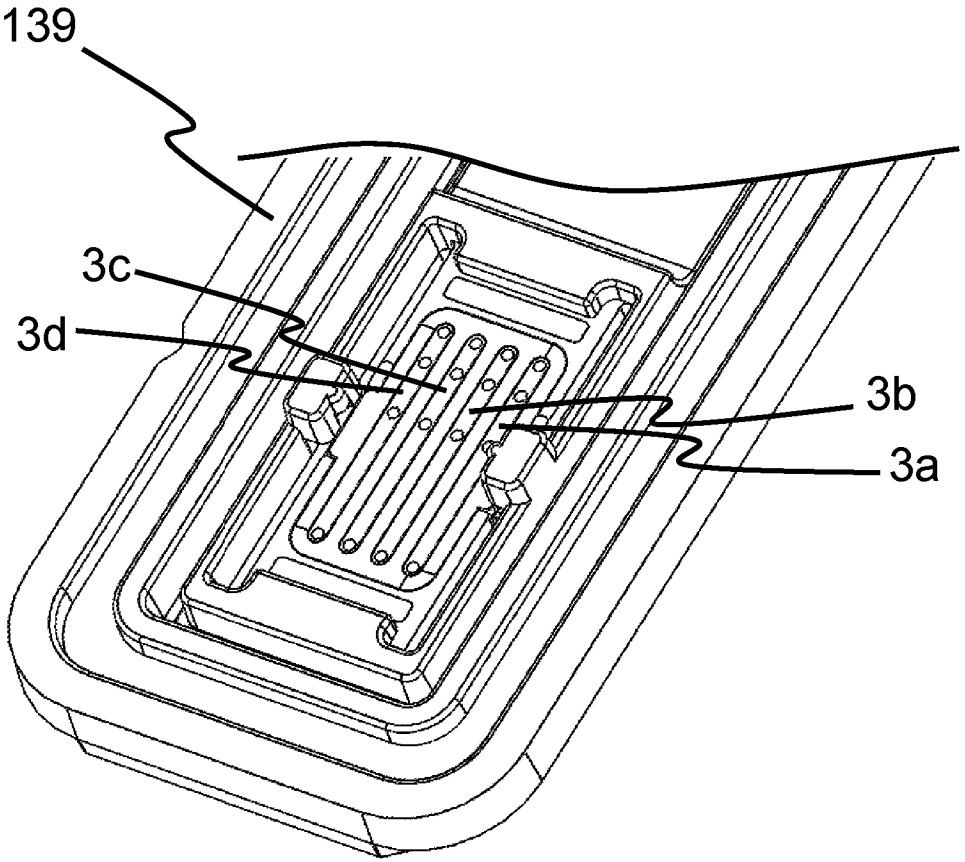
FIG. 4 provides the bottom view of a disposable cartridge, which can contain the flow cells which make up cell unit in any of the assemblies of FIG. 1 or 2.

FIG. 4 provides the bottom view of portion of an exemplary cartridge. In this example the cartridge 139 is a disposable cartridge. Referring to FIG. 4 there is shown the flow cells 3*a-d* of the flow cell unit 3 provided in the disposable cartridge 139. The flow cells 3*a-d* are integral to the disposable cartridge 139. When the flow cells 3*a-d* of the cartridge become damaged or non-useable the cartridge is simply removed, and a new cartridge is provided in the assembly.

Figure 3B:
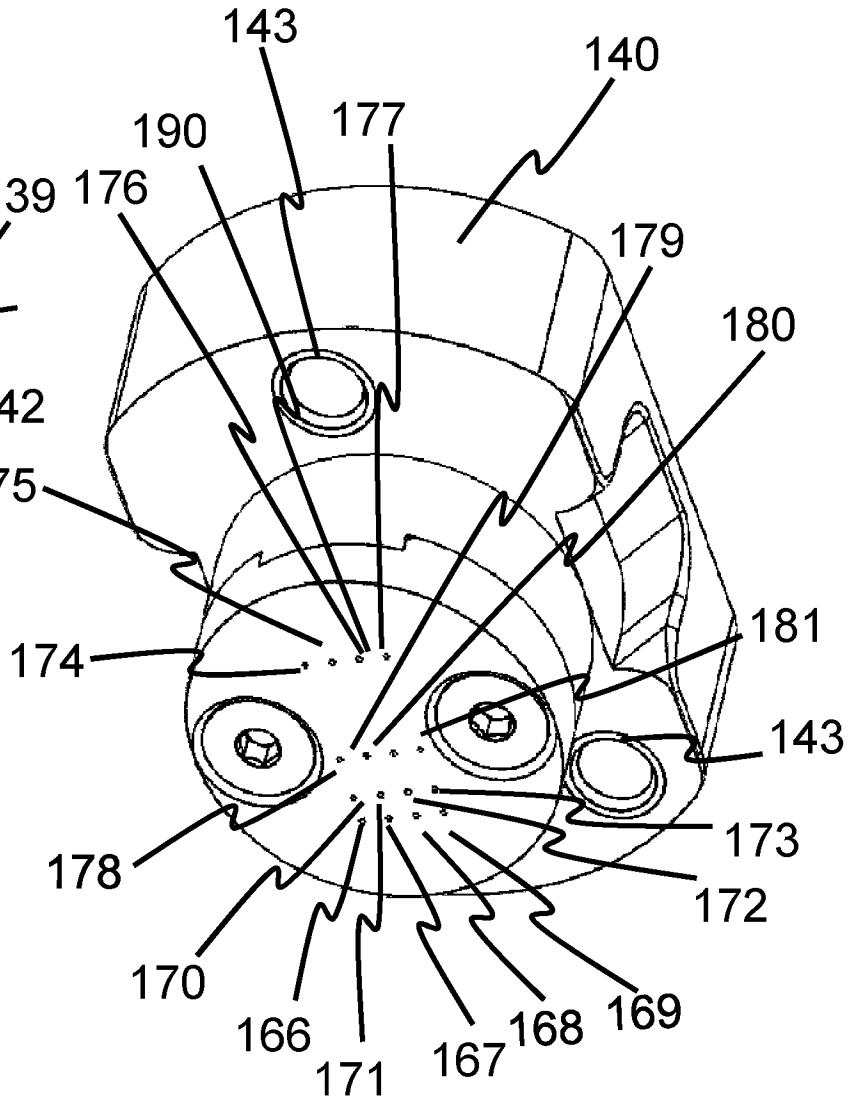
FIG. 3*a* provides a perspective view of a portion of a disposable cartridge and FIG. 3*b* provides a perspective view of a plunger assembly, wherein the disposable cartridge and plunger assembly can mechanically cooperate with one another.
Figure 3A:
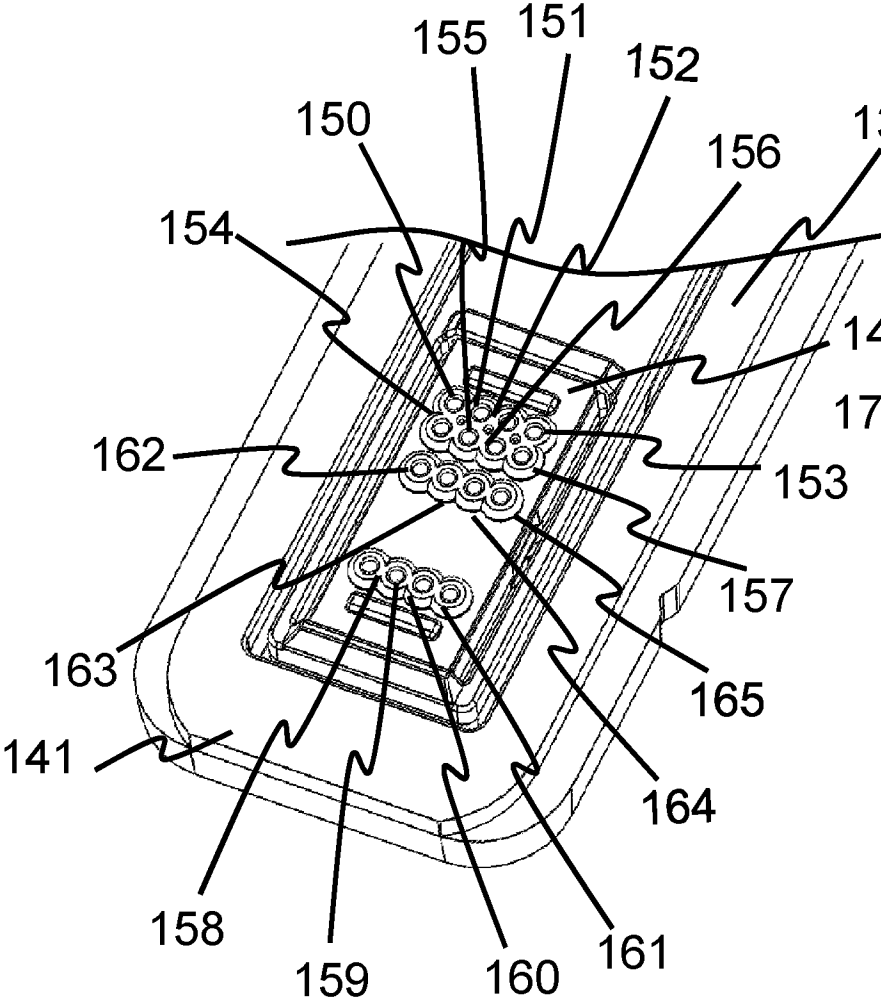

FIG. 3*a* provides a perspective view of a portion of the disposable cartridge 139 and FIG. 3*b* provides a perspective view of an exemplary plunger assembly 140, wherein the disposable cartridge 139 and plunger assembly 140 can mechanically cooperate with one another; the disposable cartridge 139 and plunger assembly 140 can be used in any of the above-mentioned assemblies.

FIG. 3*a* shows a partial perspective-top view of the cartridge 139, which can be used in any of above-described assemblies to define the flow cell unit 3. The cartridge 139 comprises fluidic interfaces 150-165. Each fluidic interface 150-165 comprises a ring member made of an elastomeric compound such as EPDM, FKM or silicone. FIG. 3*b* shows a perspective-bottom view of a plunger assembly 140 which is fixed part of the assembly. The plunger assembly 140 is suitable for cooperating with the cartridge 139. The plunger assembly 140 further comprises fluidic channels 190 having positions corresponding the positions fluidic interfaces 150-165 provided in the cartridge 139; the respective rim at the open end of each fluidic channel 190 defines a corresponding interface 166-181. The number of fluidic channels preferably corresponds to the number of fluidic interfaces 150-165 provided on the cartridge.

The cartridge 139 comprise a main body 141, the main body 141 may be injected molded, preferably comprising a thermoplastic material such as Polycarbonate or Cyclic Olefin Copolymer Preferably the plunger assembly comprises hard and inert material with high resistance to chemicals, for example precision machined or polished stainless steel or PEEK.

The plunger assembly 140 comprises linear bearings 143 which allow it to be movable in a direction perpendicular to the plane of fluidic interfaces 150-165 of the cartridge 139; in particular, the plunger assembly 140 can be moved to abut the cartridge 139 so as to bring the respective rim at the open end of each fluidic channel 190 which defines a corresponding interface 166-181, into abutment with a corresponding ring member with defines a respective fluidic interface 150-165 on the cartridge. The plunger assembly 140 and cartridge 139 may be maintained in such a position (i.e. a position where by the interfaces are aligned and abut) by means of a pinion such as a stainless steel bolt, or a spring.

Preferably, the plunger assembly 140 is positioned in the assembly so that the respective rims at the open end of each fluidic channel 190 which defines a corresponding interface 166-181, abut respective ring members on the cartridge 139 with define respective fluidic interface 150-165 form a fluid-impermeable seal between the fluidic interfaces 150-165 on the cartridge 139 and the fluidic interfaces 166-181 on the plunger assembly 140. Preferably the plunger assembly 140 is positioned so that the respective rims at the open end of each fluidic channel 190 which defines a corresponding interface 166-181, compress respective ring members on the cartridge 139 with define respective fluidic interface 150-165 form a fluid-impermeable seal between the fluidic interfaces 150-165 on the cartridge 139 and the fluidic interfaces 166-181 on the plunger assembly 140. As an example, the respective rim at the open end of the fluidic channel 190 which defines a fluidic interface 174 is pressed onto the small rings forming the ninth fluidic interface 158, thereby combining and sealing the cartridge part of the second conduit 15 and the fixed parts of the second conduit 15. When moving the plunger assembly 140 away from the cartridge, the fluidic interfaces are separated allowing easy removal and disposable and replacement of the cartridge 139.

In the depicted embodiment, the fluidic interfaces 150-165 on the cartridge 139 comprise rings of elastomeric material; preferably the rings are provided as a sinnle substrate and that sinnle substrate is attached to the main body 141 of the cartridge 139; the centre of each ring is aligned with a respective hole which is defined in the main body 141. In a further preferred embodiment, the fluidic interfaces 150-165 are formed integral to the main body 141 of the cartridge 139; in such an embodiment the main body 141 and the fluidic interfaces 150-165 may both be formed from a single injection molded part; the single injection molded part may comprise dual materials and integrated elastomeric ring seals.

Various modifications and variations to the described embodiments of the invention will be apparent to those skilled in the art without departing from the scope of the invention as defined in the appended claims. Although the invention has been described in connection with specific preferred embodiments, it should be understood that the invention as claimed should not be unduly limited to such specific embodiment.

The invention claimed is:

1. An assembly comprising, a needle unit comprising n hollow needles, wherein n is greater than one;

a flow cell unit comprising m flow cells, wherein m is greater than one, each flow cell having an input and an output, and a test surface on which ligands can be provided located between the input and output;

a first selector valve unit which is fluidly connected between the needle unit and flow cell unit, and wherein said first selector valve unit is configured so that it is operable to selectively fluidly connect any one of the n hollow needles with said m flow cells in said flow cell unit;

a pumping means which is selectively operable to provide negative pressure;

a second selector valve unit which is fluidly connected between said pumping means, and the output of each flow cell in the flow cell unit.

2. An assembly according to claim 1, wherein the first selector valve unit comprises a plurality of inputs, each input fluidly connected to a respective needle of the needle unit; and wherein the first selector valve has a single output, wherein the first selector valve is configured such that it can selectively fluidly connect any one of said inputs to the single output, so that fluid can flow from said input to said single output; and wherein the single output is fluidly connected to the respective inputs of all of said flow cells in said flow cell unit.

3. An assembly according to claim 2 wherein the first selector valve comprises a movable conduit which can be moved into a plurality of different positions, in each position the conduit fluidly connects a respective one said inputs to the single output.

4. An assembly according to claim 1, wherein the second selector valve unit comprises at least m valves, wherein m is the number of flow cells in the flow cell unit, and wherein each valve is fluidly connected to an output of a respective flow cell, and wherein the second selector valve unit can be arranged in m+1 different configurations wherein said m+1 different configurations comprise, at least, a configuration wherein each of said m valves are opened, and configurations wherein only one of said m valves are opened and the other valves are closed.

5. An assembly according to claim 1, further comprising one or more sensors which are configured to detect if molecules of a sample fluid which has been passed through a flow cell have become bound to ligands on the test surface of that flow cell.

6. An assembly according to claim 1, wherein the assembly further comprises a sample tray holder comprising a plurality of reservoirs, each reservoir defining a volume which can hold a fluid, and wherein each reservoir is configured such that a respective hollow needle of said needle unit can be selectively moved into the volume defined by the reservoir.

7. A method for screening sample fluids for predefined molecules, using the assembly of claim 1, the method comprising the steps of, arranging the second selector valve so that the pumping means is fluidly connected to all of said m flow cells in the flow cell unit;

for each needle in the needle unit consecutively, carrying out the following steps: configuring the first selector valve unit so that said needle is fluidly connected to all of said m flow cells in said flow cell unit; operating the pumping means to provide negative pressure, which aspirates a sample fluid into said needle, through said needle, into an input of the first selector valve unit , out of the first selector valve unit via the single output, and from the single output into all of the flow cells in the flow cell unit; and detecting, using a sensor, if molecules of said sample fluid have become bound to ligands on the test surfaces of one or more of said flow cells.

8. A method according to claim 7, wherein the step of detecting, using a sensor, if molecules of said first sample fluid have become bound to ligands on the test surfaces of one or more of said flow cells comprises, passing the sample fluid through a flow cell which is without ligands on its test surface;

obtaining an output signal from the sensor as the sample fluid passes through said flow cell which is without ligands on its test surface, wherein the output signal defines a reference signal;

obtaining an output signal from the sensor as the sample fluid passes through a flow cell which has ligands on its test surface;

comparing said output signal with said reference signal;

determining that molecules of said sample fluid have bound to the ligands on the test surface of the flow cell if the output signal differs from the reference signal.

9. A method according to claim 7 further comprising the steps of providing ligands on the respective test surfaces of one or more of said m flow cells in said flow cell unit.

10. A method according to claim 8 wherein the step of providing ligands on the respective test surfaces of one or more of said m flow cells in said flow cell unit comprises providing ligands on the test surfaces of a plurality of said flow cells, wherein the type of ligands provided on the test surfaces differ between flow cells such that the test surfaces of said plurality of flow cells have different types of ligands.

11. A method according to claim 9 wherein the step of providing ligands on the respective test surfaces of one or more of said flow cells in said flow cell unit, comprises, passing the first immobilization reagent through all of the m flow cells in the flow cell unit, so that the first immobilization reagent contacts the test surfaces of all of the flow cells;

for each of r different types of ligands, passing said ligands through a respective one of said m flow cells, so that the test surfaces of that respective flow cell is provided with said ligand, so that at least r of the m flow cells have test surface which have different types of ligands;

passing a second immobilization reagent though all of the m flow cells in the flow cell unit, to passivate the test surfaces of all of the m flow cells.

12. A method according to claim 11 wherein the method further comprises the steps of, passing a buffer solution though all of the m flow cells in the flow cell unit.

* * * * *